US011971049B2

(12) United States Patent
Jung et al.

(10) Patent No.: US 11,971,049 B2
(45) Date of Patent: Apr. 30, 2024

(54) BLOWER

(71) Applicant: LG ELECTRONICS INC., Seoul (KR)

(72) Inventors: Jaehyuk Jung, Seoul (KR); Seokho Choi, Seoul (KR); Changhoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/563,201

(22) Filed: Dec. 28, 2021

(65) Prior Publication Data

US 2022/0205457 A1 Jun. 30, 2022

(30) Foreign Application Priority Data

Dec. 28, 2020 (KR) ..... 10-2020-0184748

(51) Int. Cl.
*F04D 29/44* (2006.01)
*F04D 25/08* (2006.01)
*F04D 29/70* (2006.01)

(52) U.S. Cl.
CPC ..... *F04D 29/441* (2013.01); *F04D 25/08* (2013.01); *F04D 29/703* (2013.01)

(58) Field of Classification Search
CPC ..... F04D 29/441; F04D 25/08; F04D 29/703; F04F 5/16
See application file for complete search history.

(56) References Cited

U.S. PATENT DOCUMENTS

2010/0226801 A1* 9/2010 Gammack ..... F04D 25/08 417/423.1
2012/0051884 A1* 3/2012 Junkel ..... F04F 5/16 415/90
2014/0147297 A1* 5/2014 Iyer ..... F04F 5/14 417/158

(Continued)

FOREIGN PATENT DOCUMENTS

CN 101825100 9/2010
CN 102374660 3/2012
CN 202371881 8/2012

(Continued)

OTHER PUBLICATIONS

European Search Report dated May 24, 2022 issued in EP Application No. 21218006.1.

(Continued)

*Primary Examiner* — Grant Moubry
*Assistant Examiner* — Ruben Picon-Feliciano
(74) *Attorney, Agent, or Firm* — KED & ASSOCIATES, LLP

(57) ABSTRACT

A blower is provided. The blower according to the present disclosure includes: a fan causing airflow; a lower body forming an inner space at which the fan is disposed, and having a suction hole through which air passes; and a first upper body positioned above the lower body, and the first upper body may include a first wall forming a first flow path communicating with the inner space of the lower body and a first panel surrounding the first wall, and the first panel may include a first slit formed through the first panel and discharging air flowing through the first flow path to an outside of the first panel.

17 Claims, 23 Drawing Sheets

(56) References Cited

U.S. PATENT DOCUMENTS

| | | | | |
|---|---|---|---|---|
| 2015/0176860 | A1 | 6/2015 | Hattan et al. | |
| 2022/0074419 | A1* | 3/2022 | Pouget | F24F 13/26 |

FOREIGN PATENT DOCUMENTS

| | | |
|---|---|---|
| CN | 103133300 | 6/2013 |
| CN | 203336819 | 12/2013 |
| CN | 205606891 | 9/2016 |
| CN | 107535016 | 1/2018 |
| CN | 206877265 | 1/2018 |
| CN | 208918875 | 5/2019 |
| CN | 110594204 | 12/2019 |
| CN | 110822707 | 2/2020 |
| JP | 2013-113301 | 6/2013 |
| JP | 2013-213454 | 10/2013 |
| JP | 2015-063979 | 4/2015 |
| JP | 5917614 | 5/2016 |
| KR | 10-2013-0033435 | 4/2013 |
| KR | 10-1439490 | 9/2014 |
| WO | WO 2013/151036 | 10/2013 |
| WO | WO 2021/177507 | 9/2021 |
| WO | WO 2021/177713 | 9/2021 |

OTHER PUBLICATIONS

Korean Office Action dated Nov. 1, 2022 issued in KR Application No. 10-2020-0184748.
Chinese Office Action dated Apr. 29, 2023 issued in Application No. 202111625380.4.

* cited by examiner

BLOWER

CROSS-REFERENCE TO RELATED APPLICATION

This application claims the priority benefit of Korean Patent Application No. 10-2020-0184748, filed on Dec. 28, 2020, in the Korean Intellectual Property Office, the disclosure of which is incorporated herein by reference in its entirety.

BACKGROUND

Field

The present disclosure relates to a blower. In particular, the present disclosure relates to a blower capable of forming an airflow using a coanda effect.

BACKGROUND

A blower may cause a flow of air to circulate air in an indoor space or form airflow toward a user. Recently, many studies have been conducted on an air discharge structure of the blower that may give the user a sense of comfort.

In this regard, KR2011-0051724 disclose a blower forming an air flow using a coanda effect. A nozzle of the blower may form an internal passage through which air flowing by an impeller passes and may form the airflow toward an outside of the blower.

The inner passage is formed by an outer wall and an inner wall of the nozzle. However, the outer wall and the inner wall approach each other to form a mouse, thereby inducing the flow of air to a coanda surface formed on the outer wall. That is, the inner passage, the mouth, and the coanda surface are all formed by the outer wall and the inner wall.

Accordingly, the above prior art has a problem in that it is difficult to optimally design an air flow path or a surface of each configuration according to a minimization of air flow resistance or a direction of required air flow. In addition, the above prior art has a problem in that it is difficult to manufacture the outer wall and the inner wall, each of which is provided as one piece. In addition, the above prior art has a problem in that it is difficult to clean or repair a part where foreign matter such as dust is likely to accumulate because a narrow passage as a part for forming the mouse cannot be separated from the outer wall.

BRIEF DESCRIPTION OF THE DRAWINGS

The embodiments will be described in detail with reference to the following drawings in which like reference numerals refer to like elements wherein:

FIG. 20 is a top view of the blower, FIG. 21 is a perspective view of the blower in which the diffused air flow is represented by a dotted arrow.

FIG. 22 is a top view of the blower, FIG. 23 is a perspective view of the blower in which the rising airflow is represented by a dotted arrow.

DETAILED DESCRIPTION

Figure 1:
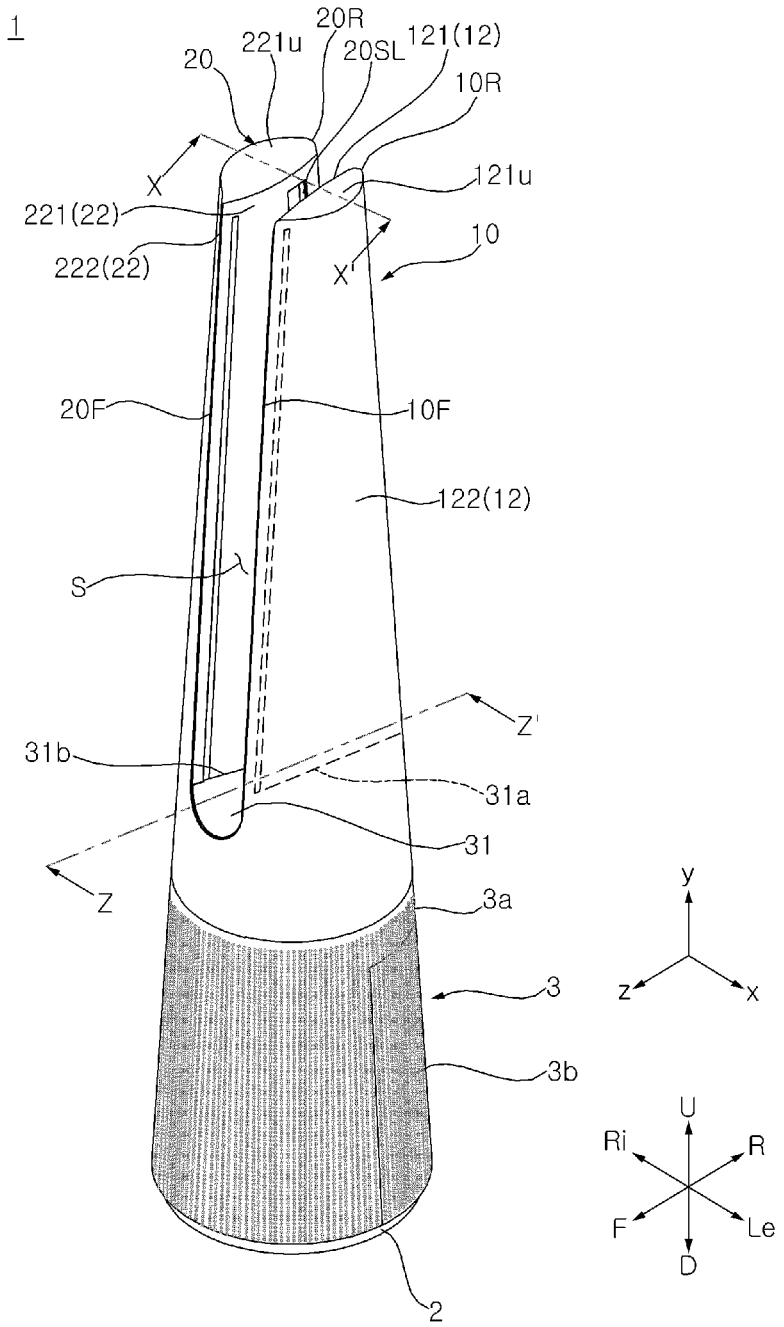
FIG. 1 is a perspective view of a blower according to an embodiment of the present disclosure.

It is an object of the present disclosure to solve the above and other problems.

It is another object of the present disclosure to provide a blower capable of forming an airflow supplied to a user or an airflow circulating in an indoor space by using the coanda effect.

It is another object of the present disclosure to provide a blower capable of forming an airflow provided in a wide range.

It is another object of the present disclosure to provide a blower capable of smoothly guiding air rising from an inside of an upper body to a slit that is an air discharge hole of the blower.

It is another object of the present disclosure to provide a blower capable of smoothly guiding flow of air discharged from a slit to a panel guiding air flow of the blower.

It is another object of the present disclosure to form an air flow path inside a blower so that a flow resistance of air is minimized, and to form an airflow in an optimum state toward an outside of the blower.

It is another object of the present disclosure to provide a blower that can be manufactured by simply assembling an upper body having various and complex curves.

It is another object of the present disclosure to provide a blower capable of cleaning or repairing pieces by easily disassembling pieces that are likely to accumulate foreign substances such as dust.

In accordance with an aspect of the present disclosure, the above and other objects can be accomplished by providing a blower, including: a fan causing airflow; a lower body forming an inner space at which the fan is disposed, and having a suction hole through which air passes; and a first upper body positioned above the lower body, the first upper body including a first wall forming a first flow path communicating with the inner space of the lower body and a first panel surrounding the first wall. That is, when the fan is operated, air is introduced into the inner space of the lower body through the suction hole and provided to the first flow path.

The first panel includes a first slit formed through the first panel and discharging air flowing through the first flow path to an outside of the first panel.

In accordance with another aspect of the present disclosure, the blower may further include a second upper body spaced apart from the first upper body above the lower body, the second upper body including a second wall forming a second flow path communicating with the inner space of the lower body, and a second panel second surrounding the second wall; and a space formed between the first upper body and the second upper body and opened in a frontward-rearward direction. That is, air flowing by the fan may be distributed to the first flow path of the first upper body and the second flow path of the second upper body spaced apart from each other with the space therebetween.

The second panel may include a second slit formed through the second panel and discharging air flowing through the second flow path to an outside of the second panel. That is, the second slit may be provided as an air discharge hole distinguished from the first slit.

In accordance with another aspect of the present disclosure, the first panel may include a first inner panel facing the space and at which the first slit is formed; and a first outer panel opposite the first inner panel with respect to the first wall, the first outer panel that contacts the first inner panel and forms a first front end and a first rear end of the first upper body, the second panel may include a second inner panel facing the space and at which the second slit is formed; and a second outer panel opposite the second inner panel with respect to the second wall, the second outer panel that contacts the second inner panel and forms a second front end and a second rear end of the second upper body. That is, the first inner panel and the second inner panel may guide the flow of air while defining a boundary of the space.

The space may be formed between the first inner panel and the second inner panel. That is, the first slit and the second slit may discharge air into the space.

In accordance with another aspect of the present disclosure, the first upper body may be spaced in a left direction from the second upper body, the first inner panel may be convex in a right direction, the first outer panel may be convex in the left direction, the second inner panel may be convex in the left direction, the second outer panel may be convex in the right direction, a curvature of the first inner panel may be smaller than a curvature of the first outer panel, and a curvature of the second inner panel may be smaller than a curvature of the second outer panel.

A gap between the first inner panel and the second inner panel may decrease from a rear of the space to a center of the space and increases from the center of the space to a front of the space. That is, air may be dispersed in a left-right direction while passing through the space, so that the blower may form airflow provided in a wide range.

In accordance with another aspect of the present disclosure, the first upper body may further include a first opening communicating with the first flow path and having an outlet forming the first slit. That is, air flowing through the first flow path may flow into the first opening and pass through the first slit that is an outlet of the first opening.

In accordance with another aspect of the present disclosure, the first panel further may include a first bending part bent from the first panel toward the first flow path; a first guide part connected to the first bending part in a front of the first bending part; and a first inlet part spaced apart from the first bending part rearward, The first slit may be formed between the first bending part and the first inlet part.

In accordance with another aspect of the present disclosure, the first wall may have one end adjacent to the first guide part, and the other end spaced apart from the one end and connected to the first inlet part.

At least a portion of the first bending part may be disposed between the one end of the first wall and the other end of the first wall, and the first upper body further include a first connecting member disposed between the one end of the first wall and the first bending part, and connected to the one end of the first wall and the first bending part.

The first opening may be formed between the first connecting member and the first bending part, and the first wall and the first inlet part.

In accordance with another aspect of the present disclosure, one end of the first connecting member may be disposed between the first wall and the first guide part, and the other end of the first connecting member may be connected to an end of the first bending part. That is, the first connecting member may define a part of the boundary of the first opening.

The first connecting member may further include a first part forming the one end of the first connecting member; a second part bent from the first part toward the first opening; and a third part extending from the second part toward the first bending part and forming the other end of the first connecting member.

In accordance with another aspect of the present disclosure, the other end of the first wall may be connected to an inside of the first inlet part, and the first inlet part may further include a front part protruding from the other end of the first wall toward the first bending part and having an inner surface facing the third part.

The first opening may be formed between the second part, the third part and the first bending part, and the first wall and the front part.

In accordance with another aspect of the present disclosure, a gap between the second part and the first wall may be constant or become smaller toward a downstream of the first opening. That is, a portion between the second part and the first wall as a portion of the first opening may reduce a flow loss or increase a flow velocity while changing the flow direction of air.

In accordance with another aspect of the present disclosure, a gap between the third part and the front part may be constant or become smaller toward a downstream of the first opening. That is, a portion between the third part and the front part as a portion of the first opening may guide air to the first guide part forming a coanda surface, thereby reducing flow loss or increasing flow rate.

In accordance with another aspect of the present disclosure, the first upper body may further include a groove formed in at least one of the third part and the first bending part and facing an inner surface of the front part. That is, the groove may minimize disturbance in the flow direction of the air passing through the first opening.

In accordance with another aspect of the present disclosure, the first upper body may further include a spacer coupled to the first bending part and the first inlet part, and disposed between the first bending part and the front part. That is, the spacer may fix a position of the first bending part with respect to the front part.

A thickness of the front part may be increased as it is adjacent to the spacer. That is, the stiffness of the spacer may be improved through a change in the thickness of the front part of with respect to the spacer.

In accordance with another aspect of the present disclosure, the first connecting member may be detachably coupled to the first wall through a hook coupling between a first hook and a first locking part.

One of the first hook and the first locking part may be formed at the first connecting member, and the other may be formed at the first wall.

In accordance with another aspect of the present disclosure, the first connecting member may be detachably coupled to the first bending part through a hook coupling between a second hook and a second locking part.

One of the second hook and the second locking part may be formed at the first connecting member, and the other may be formed at the first bending part.

In accordance with another aspect of the present disclosure, the first flow path may be formed to be elongated in an up-down direction, and the first slit may be formed at a rear portion of the first panel. That is, air may rise in the first flow path and may pass through the first slit at the rear portion of the first panel.

The first upper body may further include a first vane disposed in the first flow path adjacent to the first slit and having a convex upward shape, and a rear end of the first vane may be positioned above a front end of the first vane. That is, the first vane may smoothly guide air rising from the first flow path to the first slit.

In accordance with another aspect of the present disclosure, the first flow path may be formed to be elongated in an up-down direction, and the first slit may be formed to be elongated in a rear portion of the first panel. That is, air may rise in the first flow path and may pass through the first slit over a long range at the rear portion of the first panel.

The first upper body may further include a first heater extending in a longitudinal direction of the first slit and installed in the first flow path and heating air flowing through the first flow path. That is, when the heater is driven, the blower may provide warm air to a user or the like.

The first heater may include a plurality of first fins extending in a direction crossing or perpendicular to a longitudinal direction of the first heater, spaced apart from each other, and forming a flow path for air. That is, the plurality of first fins may smoothly guide air rising from the first flow path to the first slit.

In accordance with another aspect of the present disclosure, the first upper body may further include a first protrusion disposed between an inner side of the first wall and the first heater and protruding from the inner side of the first wall toward the first flow path.

The first protrusion may include a first vertical part elongated in the up-down direction; and a first curved part bent toward the first slit from an upper end of the vertical part. That is, the first vertical part and the first curved part may more smoothly guide air rising in the first flow path to the first slit.

In accordance with another aspect of the present disclosure, it is possible to provide a blower including: a fan causing airflow; a lower body forming an inner space at which the fan is disposed and having a suction hole through which air passes; and an upper body positioned above the lower body and having a wall disposed inside the upper body, forming a flow path communicating with the inner space of the lower body, and having one end and the other end spaced apart from each other.

That is, when the fan is operated, air may be introduced into the inner space of the lower body through the suction hole and provided to the flow path of the wall.

The upper body may include a slit formed on a surface of the upper body; and an opening positioned between the one end of the wall and the other end of the wall, communicating with the flow path, and having an outlet forming the slit. That is, a portion of the upper body forming the slit may form a portion of the opening.

In accordance with another aspect of the present disclosure, it is possible to provide a blower including: a fan causing airflow; a lower body forming an inner space at which the fan is disposed, and having a suction hole through which air passes; and an upper body positioned above the lower body, the upper body providing a flow path communicating with the inner space of the lower body, and the upper body may include a wall disposed inside the upper body and forming the flow path; and a panel accommodating the wall and forming a surface of the upper body. That is, when the fan is operated, air may be introduced into the inner space of the lower body through the suction hole and provided to the flow path of the wall.

The panel may include an inner panel having a slit discharging air flowing through the flow path to an outside of the panel; and an outer panel opposite the inner panel with respect to the wall. That is, the slit may be provided as an air discharge hole.

The inner panel may be detachably coupled to the wall. That is, the user may easily clean or repair the inner panel by separating the inner panel from the wall.

Hereinafter, exemplary embodiments disclosed in the present specification will be described in detail with reference to the accompanying drawings, but identical or similar elements are denoted by the same reference numerals regardless of reference numerals, and redundant descriptions thereof will be omitted.

In describing the embodiments disclosed in the present specification, when it is determined that a detailed description of related known technologies may obscure the subject matter of the embodiments disclosed in the present specification, the detailed description thereof will be omitted. In addition, the accompanying drawings are for easy understanding of the embodiments disclosed in the present specification, and the technical idea disclosed in the present specification is not limited by the accompanying drawings, and it is to be understood as including all changes, equivalents, and substitutes included in the spirit and technical scope of the present disclosure.

Terms including ordinal numbers, such as first and second, may be used to describe various elements, but the elements are not limited by the terms. The terms are used only for the purpose of distinguishing one component from another component.

Direction indications of up U, down D, left Le, right Ri, front F and rear R shown in the drawings are for convenience of description only, and the disclosed technical idea is not limited by these.

Referring to FIG. 1, a blower 1 may be elongated long in an up-down direction. The blower 1 may include a base 2, a lower body 3, upper bodies 10 and 20.

The base 2 may form a lower surface of the blower 1 and may be placed on a floor of an indoor space. The base 2 may be formed in a circular plate shape as a whole.

The lower body 3 may be disposed above the base 2. The lower body 3 may form a lower side of the blower 1. The lower body 3 may be formed in a cylindrical shape as a whole. For example, a diameter of the lower body 3 may decrease from a lower part to an upper part of the lower body 3. For another example, the diameter of the lower body 3 may be kept constant in the up-down direction. A suction hole 3*a* may be formed to pass through a side surface of the lower body 3. For example, a plurality of suction holes 3*a* may be evenly disposed along a circumferential direction of the lower body 3. As a result, air may flow from an outside to an inside of the blower 1 through the plurality of suction holes 3*a*.

The upper bodies 10 and 20 may be disposed above the lower body 3. The upper bodies 10 and 20 may provide a flow path communicating with an inner space of the lower body 3.

Referring to the drawings, for example, the upper bodies 10 and 20 may include a first upper body 10 and a second upper body 20 spaced apart from each other.

For another example, the upper bodies 10 and 20 may be provided as a single upper body. In this case, the upper bodies 10 and 20 may be elongated in the up-down direction from an upper side of the lower body 3 or formed in a shape of a circle (oval) or track-shaped ring or an open ring. A position of the single upper bodies 10 and 20 with respect to the lower body 3 may be determined in consideration of the shape of the upper bodies 10 and 20, and a position, shape, and number of slits formed on surfaces of the upper bodies 10 and 20 as air discharge holes formed at the upper bodies 10 and 20.

Hereinafter, for brief description, it will be described based on a case where the upper bodies 10 and 20 include the first upper body 10 and the second upper body 20. In addition, the description of this may be applied equally to a case where the upper bodies 10 and 20 are provided as a single upper body, unless it is applicable only when the number of the upper bodies 10 and 20 is two.

The first upper body 10 and the second upper body 20 may be disposed above the lower body 3. The first upper body 10 and the second upper body 20 may form an upper side of the blower 1. The first upper body 10 and the second upper body 20 extend long in the up-down direction and may be spaced apart from each other in a left-right direction. Meanwhile, the first upper body 10 may be referred to as a first tower or a first nozzle tower, and the second upper body 20 may be referred to as a second tower or a second nozzle tower.

A space S is formed between the first upper body 10 and the second upper body 20 to provide a flow path for air. The space S may be opened in a front-rear direction. Meanwhile, the space S may be referred to as a blowing space, a valley, or a channel.

The first upper body 10 may be spaced apart from the second upper body 20 to the left. The first upper body 10 may be elongated in the up-down direction. The first upper body 10 may include a first panel 12 forming an outer surface or a surface of the first upper body 10. The first panel 12 may include a first inner panel 121 facing the space S and a first outer panel 122 opposite to the first inner panel 121.

The first inner panel 121 may be convex in a direction from the first upper body 10 toward the space S or the right. For example, the first inner panel 121 may be elongated in the up-down direction. The first outer panel 122 may be convex in a direction opposite to the direction from the first upper body 10 toward the space S or to the left. For example, the first outer panel 122 may be inclined and extended by a predetermined angle (acute angle) toward the space S or to the right with respect to a vertical line extending in the up-down direction.

In this case, a curvature of the first outer panel 122 may be greater than a curvature of the first inner panel 121. In addition, the first outer panel 122 may meet the first inner panel 121 to form an edge. The edge may be provided as a first front end 10F and a first rear end 10R of the first upper body 10. For example, the first front end 10F may be inclined and extended by a certain angle (acute angle) backward with respect to the vertical line extending in the up-down direction. For example, the first rear end 10R may be inclined and extended by a predetermined angle (acute angle) forward with respect to the vertical line extending in the up-down direction.

The second upper body 20 may be spaced apart from the first upper body 10 to the right. The second upper body 20 may be elongated in the up-down direction. The second upper body 20 may include a second panel 22 forming an outer surface or a surface of the second upper body 20. The second panel 22 may include a second inner panel 221 facing the space S and a second outer panel 222 opposite to the second inner panel 221.

The second inner panel 221 may be convex in a direction from the second upper body 20 toward the space S or to the left. For example, the second inner panel 221 may be elongated in the up-down direction. The second outer panel 222 may be convex in a direction opposite to the direction from the second upper body 20 toward the space S or to the right. For example, the second outer panel 222 may extend in the direction toward the space S or to the left by a certain angle (acute angle) with respect to the vertical line extending in the up-down direction.

In this case, a curvature of the second outer panel 222 may be greater than a curvature of the second inner panel 221. In addition, the second outer panel 222 may meet with the first inner panel 221 to form an edge. The edge may be provided as a second front end 20F and a second rear end 20R of the second upper body 20. For example, the second front end 20F may be inclined and extended by a predetermined angle (acute angle) backward with respect to the vertical line extending in the up-down direction. For example, the second rear end 20R may be inclined and extended by a predetermined angle (acute angle) with respect to the vertical line extending in the up-down direction.

Meanwhile, the first upper body 10 and the second upper body 20 may be symmetrical in the left-right direction with the space S interposed therebetween. And the surface of the first outer panel 122 and the surface of the second outer panel 222 may be positioned on a virtual curved surface extending along an outer surface or a surface of the lower body 3. In other words, the surface of the first outer panel 122 and the surface of the second outer panel 222 may be smoothly connected to the surface of the lower body 3. In addition, an upper surface 121*u* of the first upper body 10 and an upper surface 221*u* of the second upper body 20 may be provided as horizontal surfaces. In this case, the blower 1 may be formed in a truncated cone shape as a whole. As a result, the risk of the blower 1 being overturned by an external impact may be lowered.

A groove 31 may be positioned between the first upper body 10 and the second upper body 20 and may be elongated long in a front-rear direction. The groove 31 may be a curved surface concave downward. The groove 31 may include a first side 31*a* connected to a lower side of the first inner panel 121 and a second side 31*b* connected to a lower side of the second inner panel 221. The groove 31 may define a boundary of the space S together with the first inner panel 121 and the second inner panel 221. Meanwhile, the groove 31 may be referred to as a connection groove or a connection surface.

For example, a cover 3*b* may be detachably coupled to the lower body 3. The cover 3*b* may be provided as a part of the lower body 3. At this time, the suction holes 3*a* may also be formed in the cover 3*b*. When the cover 3*b* is separated from the lower body 3, the user can access the inner space of the lower body 3.

For example, a display (not shown) may be provided at the front of the lower body 3 to display driving information of the blower 1 or may provide an interface for receiving a user's command. The display may include a touch panel.

Figure 2:
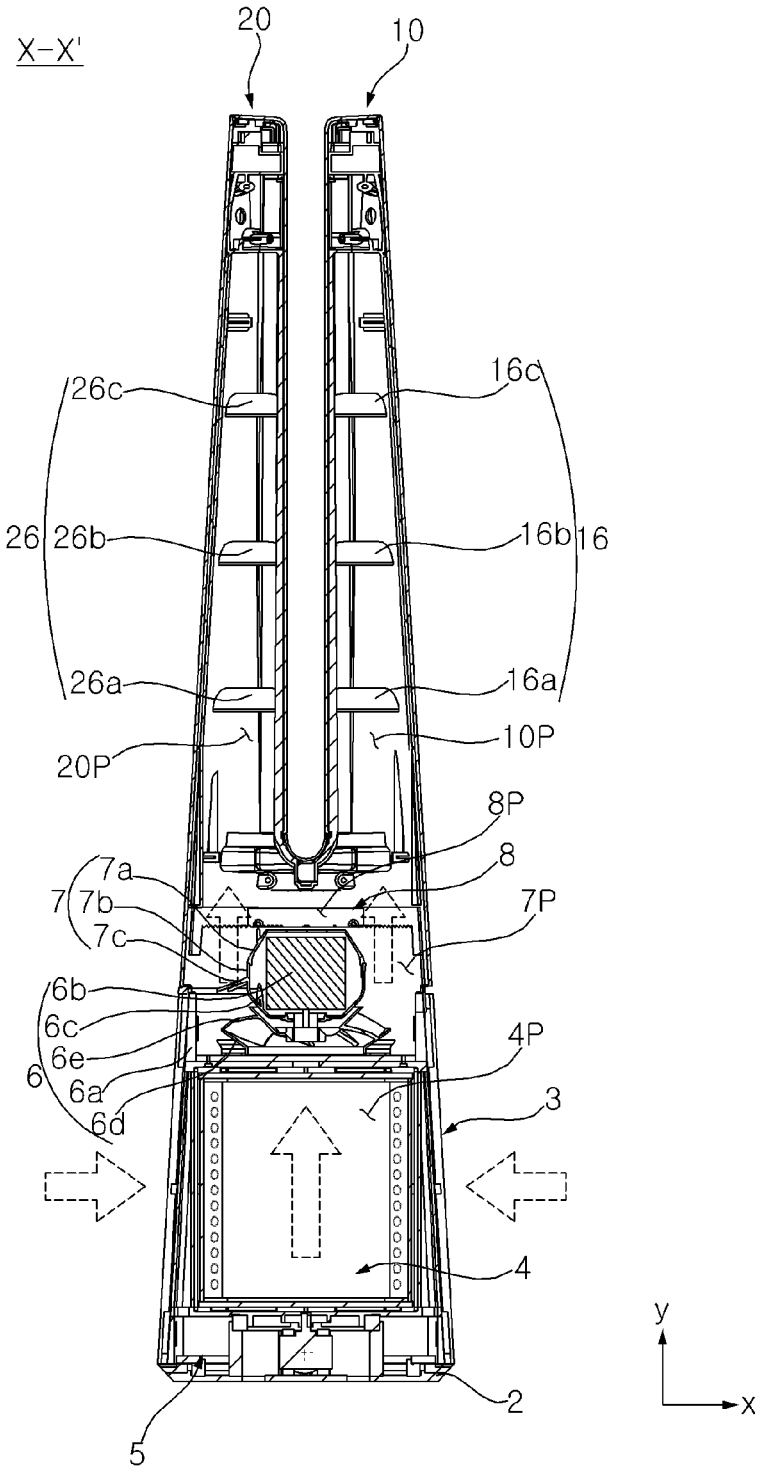
FIG. 2 is a cross-sectional view taken along line X-X' of FIG. 1 and is a longitudinal cross-sectional view of a blower according to an embodiment of the present disclosure.

Referring to FIG. 2, the lower body 3 may provide the inner space in which a filter 4, a control unit 5, a fan 6, and an air guide 7 to be described later are installed.

The filter 4 may be detachably installed in the inner space of the lower body 3. The filter 4 may be formed in a cylindrical shape as a whole. That is, the filter 4 may include a hole 4P formed to pass through the filter 4 in the up-down direction. In this case, indoor air may flow into the lower body 3 through the suction hole 3*a* (see FIG. 1) by an operation of the fan 6. And, indoor air flowing into the lower body 3 may be purified by flowing from an outer circumferential surface of the filter 4 to an inner circumferential surface of the filter 4 and may flow to an upper side of the filter 4 through the hole 4P.

The control unit 5 may be installed in the inner space of the lower body 3. The control unit 5 is disposed between the base 2 and the filter 4 and may be fixed to the base 2. The control unit 5 may support the filter 4 and may be referred to as a supporter for the filter 4. The control unit 5 is electrically connected to each component of the blower to control the operation of the blower 1. Meanwhile, the flow of air passing through the filter 4 may also be used for cooling the control unit 5 including a heat generating element.

The fan 6 may be installed in the inner space of the lower body 3 and may be disposed above the filter 4. The fan 6 may cause the flow of air that is introduced into the blower 1 or discharged from the blower 1 to the outside. The fan 6 may include a fan housing 6*a*, a fan motor 6*b*, a hub 6*c*, a shroud 6*d*, and a blade 6*e*. Meanwhile, the fan 6 may be referred to as a fan assembly or a fan module.

The fan housing 6*a* may form an exterior of the fan 6. The fan housing 6*a* may include a suction port (unsigned) formed through the fan housing 6*a* in the up-down direction. The suction port may be provided at a lower end of the fan housing 6*a* and may be referred to as a bell mouth.

The fan motor 6*b* can provide rotational force. The fan motor 6*b* may be a centrifugal fan or a four-flow fan motor. The fan motor 6*b* may be supported by a motor cover 7*b* to be described later. At this time, a rotation shaft of the fan motor 6*b* may extend from the fan motor 6*b* to a lower side of the fan motor 6*b* and may penetrate a lower surface of the motor cover 7*b*. The hub 6*c* may be rotated together with the rotation shaft by being coupled to the rotation shaft. The shroud 6*d* may be spaced from the hub 6*c* to the outside of the hub 6*c*. Plurality of blades 6*e* may be disposed between the hub 6*c* and the shroud 6*d*.

Accordingly, when the fan motor 6*b* is driven, air may be introduced in an axial direction of the fan motor 6*b* through the suction port and discharged to a radial direction of the fan motor 6*b* and to an upper side of the fan motor 6*b*.

The air guide 7 may be disposed above or below the fan 6 to provide a flow path 7P through which air discharged from the fan 6 flows. For example, the flow path 7P may be an annular flow path. The air guide 7 may include a guide body 7*a*, a motor cover 7*b*, and vanes 7*c*. Meanwhile, the air guide 7 may be referred to as a diffuser.

The guide body 7*a* may form an exterior of the air guide 7. The motor cover 7*b* may be disposed in a center of the air guide 7. For example, the guide body 7*a* may be formed in a cylindrical shape. In addition, the motor cover 7*b* may be formed in a bowl shape. In this case, the above-described annular flow path 7P may be formed between the guide body 7*a* and the motor cover 7*b*. Plurality of vanes 7*c* may be disposed in the annular flow path 7P and may be spaced apart from each other in a circumferential direction of the guide body 7*a*. Each of the plurality of vanes 7*c* may extend from an outer surface of the motor cover 7*b* to an inner circumferential surface of the guide body 7*a*. Accordingly, the plurality of vanes 7*c* may guide air provided from the fan 6 to the flow path 7P to an upper side of the air guide 7.

The distribution unit 8 may be disposed above or downstream of the air guide 7 and may be disposed below or upstream of the upper bodies 10 and 20. The distribution unit 8 may provide a flow path 8P through which the air passing through the air guide 7 flows. Air passing through the air guide 7 may be distributed to the first upper body 10 and the second upper body 20 through the distribution unit 8. In other words, the air guide 7 can guide the air flowing by the fan 6 to the distribution unit 8 and the distribution unit 8 may guide air introduced from the air guide 7 to the first upper body 10 and the second upper body 20. Meanwhile, the distribution unit 8 may be referred to as a splitter, a middle body, an inner body, a tower base, or a nozzle tower base.

The first upper body 10 may provide a first flow path 10P through which a part of the air passing through the air guide 7 and the distribution unit 8 flows. The first flow path 10P may be formed in the inner space of the first upper body 10. The second upper body 20 may provide a second flow path 20P through which the rest of the air passing through the air guide 7 and the distribution unit 8 flows. The second flow path 20P may be formed in the inner space of the second upper body 20. That is, the first flow path 10P and the second flow path 20P may communicate with the flow path 8P of the distribution unit 8 and the flow path 7P of the air guide 7.

Figure 3:
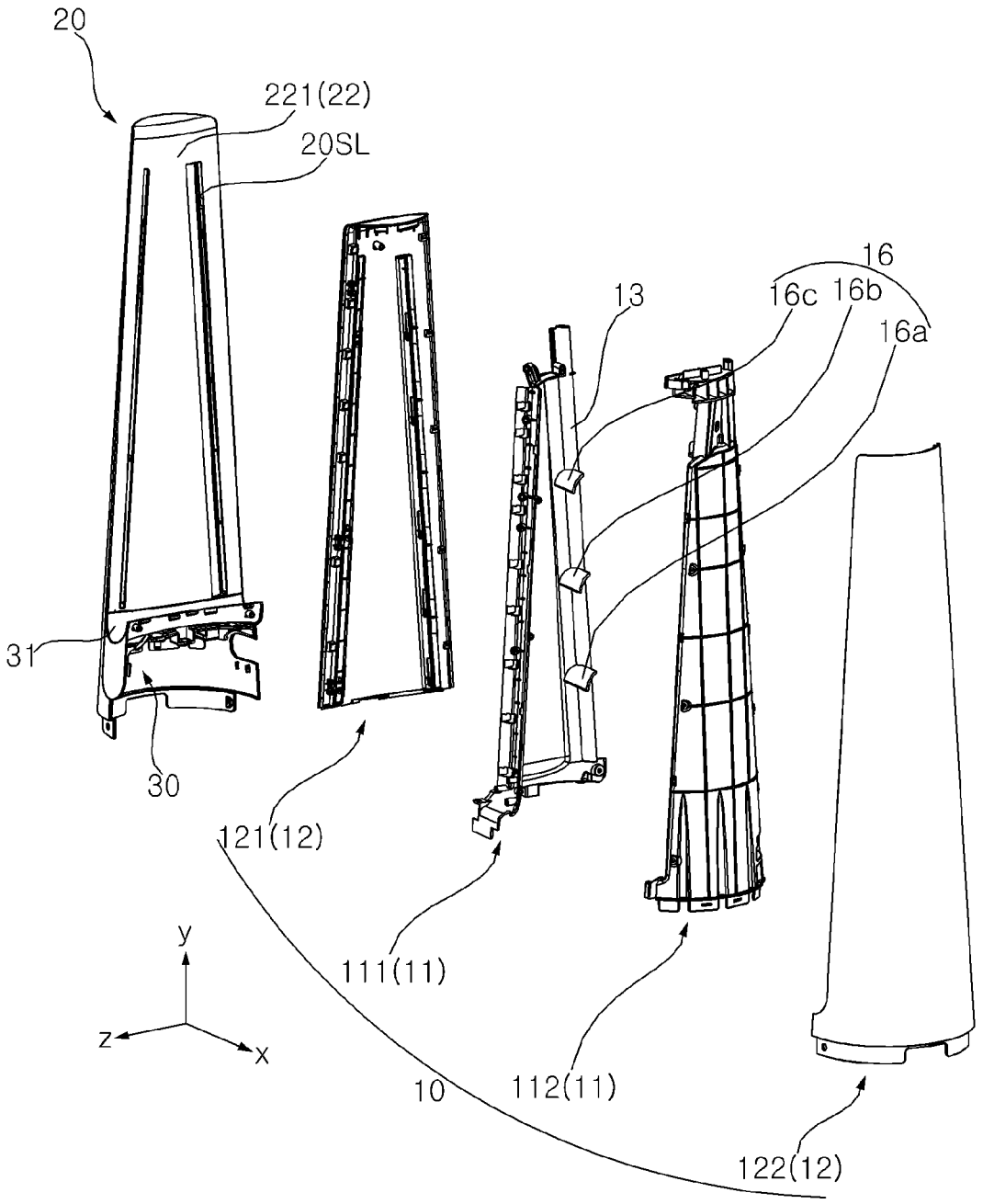
FIGS. 3 to 5 are exploded perspective views of a first upper body and a second upper body of a blower according to an embodiment of the present disclosure.
Figure 5:
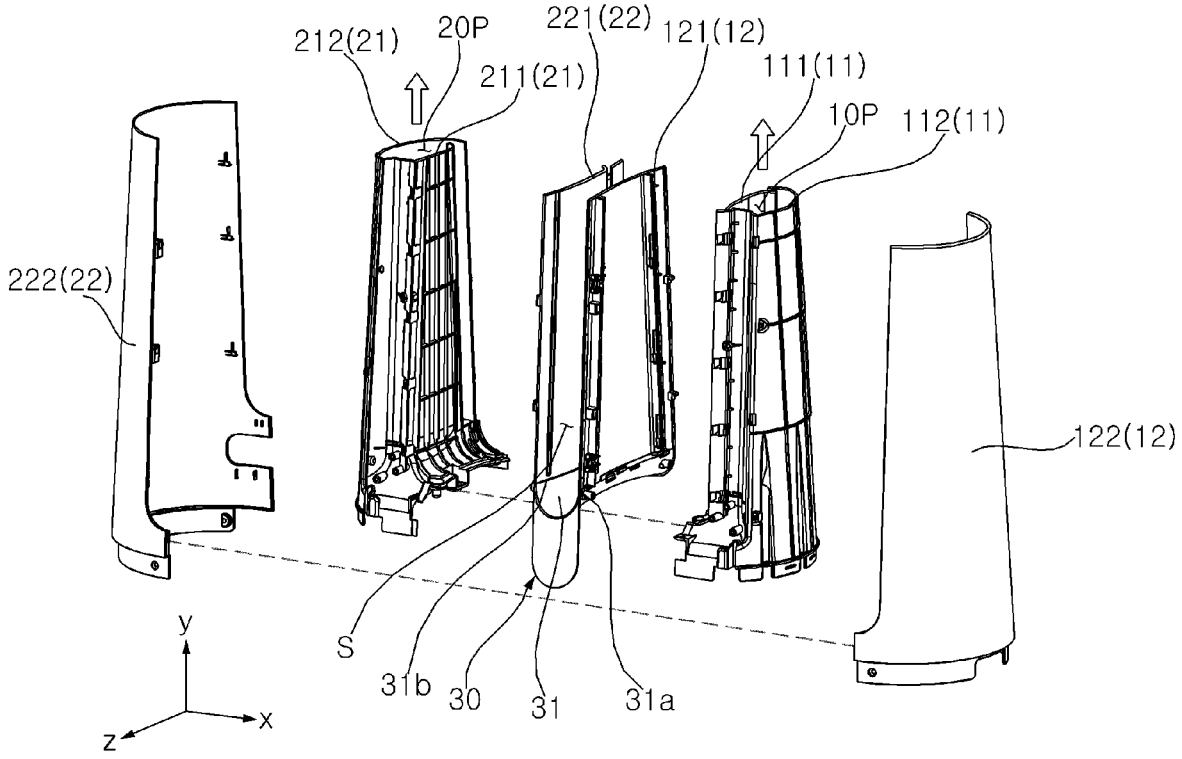

Referring to FIGS. 3 and 5, the first upper body 10 may include a first wall 11 in addition to the first inner panel 121 and the first outer panel 122 described above. The first wall 11 may be positioned between the first inner panel 121 and the first outer panel 122. That is, the first panel 12 may surround the first wall 11. In other words, the first wall 11 may be accommodated in the first panel 12. The first wall 11 may include a first inner wall 111 facing an inner side of the first inner panel 121 and a first outer wall 112 facing an inner side of the first outer panel 122.

The first inner wall 111 may be detachably coupled to an inside of the first inner panel 121. The first outer wall 112 may be detachably coupled to the inner side of the first outer panel 122. The first inner wall 111 and the first outer wall 112 may be coupled to each other to form the first flow path 10P. In addition, the first inner panel 121 may be coupled to or fixed to a groove body 30 having the groove 31.

Accordingly, the first panel 12 may form the surface of the first upper body 10, and the first wall 11 may provide the first flow path 10P through which air (refer to the arrow in FIG. 5) flows.

Figure 4:
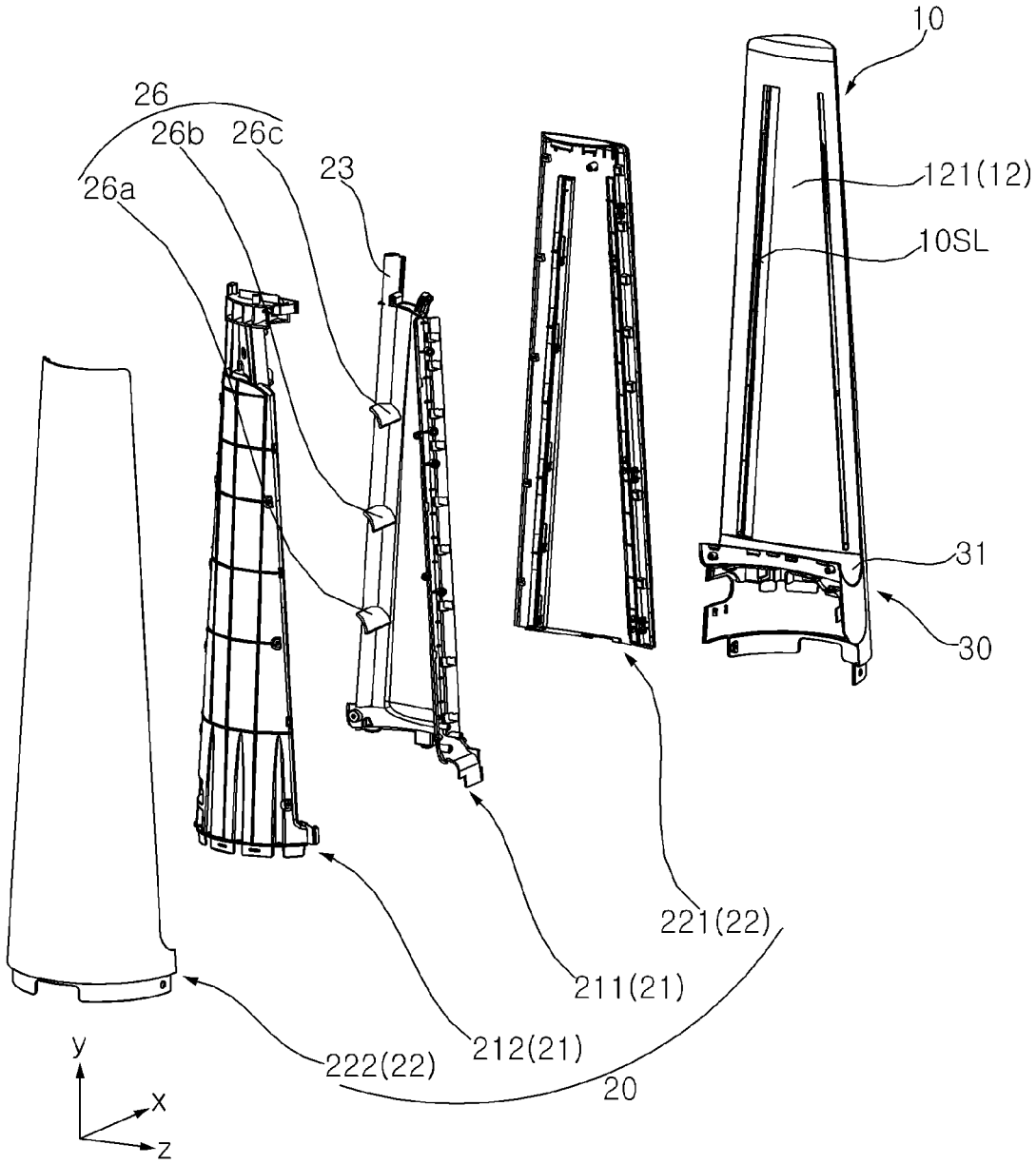

Referring to FIGS. 4 and 5, the second upper body 20 may include a second wall 21 in addition to the second inner panel 221 and the second outer panel 222 described above. The second wall 21 may be positioned between the second inner panel 221 and the second outer panel 222. That is, the second panel 22 may surround the second wall 21. In other words, the second wall 21 may be accommodated in the second panel 22. The second wall 21 may include a second inner wall 211 facing an inner side of the second inner panel 221 and a second outer wall 212 facing an inner side of the second outer panel 222.

The second inner wall 211 may be detachably coupled to the inner side of the second inner panel 221. The second outer wall 212 may be detachably coupled to the inner side of the second outer panel 222. The second inner wall 211 and the second outer wall 212 may be coupled to each other to form the second flow path 20P. In addition, the second inner panel 221 may be coupled to or fixed to the groove body 30 having the groove 31.

Accordingly, the second panel 22 may form the surface of the second upper body 20, and the second wall 21 may provide the second flow path 20P through which air (refer to the arrow in FIG. 5) flows.

Figure 6:
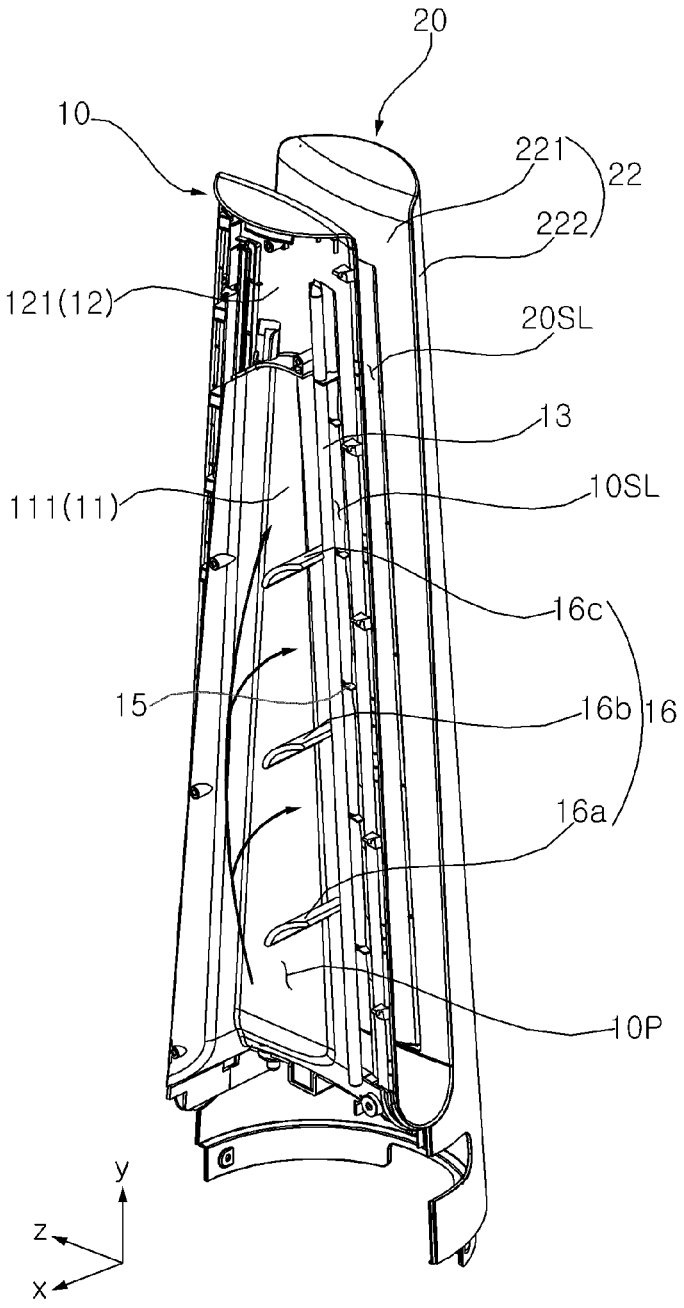
FIG. 6 is a perspective view illustrating a state in which a first outer panel is removed from a first upper body of a blower according to an embodiment of the present disclosure.

Referring to FIG. 6, a first vane 16 may be installed in the first flow path 10P. The first vane 16 may be coupled to an inner side of the first wall 11. For example, the first vane 16 may be positioned between the first inner wall 111 and the first outer wall 112 (refer to FIG. 3), and a right end of the first vane 16 may be detachably coupled or fixed to the inner surface of the first inner wall 111. For another example, the first vane 16 may be positioned between the first inner wall 111 and the first outer wall 112 (refer to FIG. 3), a left end of the first vane 16 may be detachably coupled or fixed to the inner surface of the first outer wall 112. Accordingly, the first vane 16 may be coupled to or separated from the first wall 11.

The first vane 16 may be adjacent to a first slit 10SL of the first upper body 10 to be described later. The first vane 16 may have a convex upward shape. A rear end of the first vane 16 may be positioned above a front end of the first vane 16. In this case, the front end of the first vane 16 may be spaced apart from the inner surface of the first inner wall 111, and at least a part of the rear end of the first vane 16 may be connected to a first connecting member 13 of the first upper body 10 to be described later. For example, the first vane 16 may include a plurality of first vanes 16*a*, 16*b*, and 16*c* spaced apart from each other in the up-down direction. A left end of each of the plurality of first vanes 16*a*, 16*b*, and 16*c* may contact an inner surface of the first outer wall 112 (refer to FIGS. 2 and 3). The inner surface of the first outer wall 112 may have a large curvature. A right end of each of the plurality of first vanes 16*a*, 16*b*, and 16*c* may contact an inner surface of the first inner wall 111 (refer to FIG. 2). The inner surface of the first inner wall 111 may have a small curvature. In the horizontal direction, a width of each of the plurality of first vanes 16*a*, 16*b*, and 16*c* may gradually decrease from the front end to the rear end thereof. In the horizontal direction, among the plurality of first vanes 16*a*, 16*b*, and 16*c*, a vane positioned at a relatively upper side may have a smaller width than a vane positioned at a relatively lower side. In the direction of curvature of the plurality of first vanes 16*a*, 16*b*, and 16*c*, among the plurality of first vanes 16*a*, 16*b*, and 16*c*, a vane positioned at a relatively upper side may have a shorter length than a vane positioned at a relatively lower side. That is, among the plurality of first vanes 16*a*, 16*b*, and 16*c*, a vane positioned at a relatively upper side may be smaller than a vane positioned at a relatively lower side. The plurality of first vanes 16*a*, 16*b*, and 16*c* may be disposed along the first connecting member 13. That is, the plurality of first vanes 16*a*, 16*b*, and 16*c* may be disposed along an imaginary line inclined forward by a certain angle with respect to a vertical line VL (refer to FIG. 9).

Meanwhile, a second vane (refer to FIG. 4) may be installed in the second flow path 20P, and the above-described contents for the first vane 16 may be applied in the same manner.

Accordingly, the first vane 16 may smoothly guide the air rising in the first flow path 10P to the rear. In addition, the second vane 16 may smoothly guide the air rising in the second flow path 20P (refer to FIG. 4) to the rear.

Figure 7:
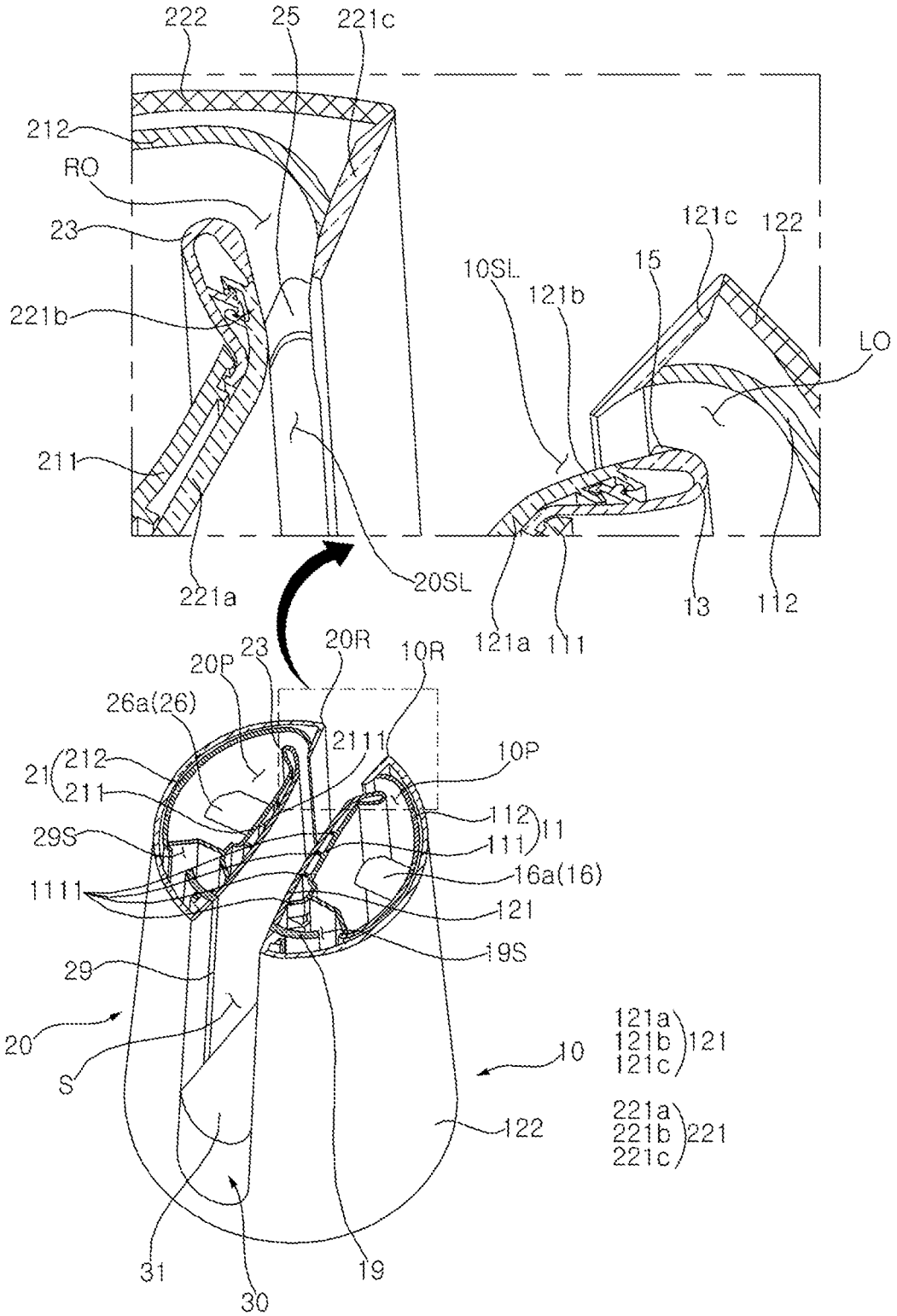
FIG. 7 is a perspective view illustrating an internal configuration of a blower according to an embodiment of the present disclosure by cutting out parts of a first upper body and a second upper body.

Referring to FIG. 7, the first connecting member 13 may be positioned in the first flow path 10P, may be coupled to or fixed to the first inner wall 111, and may be connected to the rear end of the first vane 16. A second connecting member 23 may be positioned in the second flow path 20P, and may be connected to a rear end of the second vane 26.

The first connecting member 13 may extend obliquely to the left toward the rear from the first inner wall 111. In addition, the first connecting member 13 may be adjacent to a first rear end 10R of the first upper body 10 and spaced apart from the first outer wall 112. In this case, a part of a first opening LO may be positioned between the first connecting member 13 and the first outer wall 112 and may be formed to be inclined to the right toward the front. Here, the first opening LO may communicate with the first flow path 10P. Meanwhile, the first opening LO may be referred to as a first discharge port or a first mouse.

Accordingly, the air flowing through the first flow path 10P may be guided rearward by the first vane 16 and may be introduced into an inlet of the first opening LO.

The first slit 10SL may be adjacent to the first rear end 10R of the first upper body 10 and may be formed to penetrate the first inner panel 121. The first slit 10SL may be elongated along the first rear end 10R of the first upper body 10. The first slit 10SL may be an outlet of the first opening LO. Accordingly, the first slit 10SL may discharge air flowing through the first flow path 10P into the space S.

For example, a part of the first inner panel 121 may be adjacent to the first rear end 10R of the first upper body 10 and may be cut from the rest of the first inner panel 121 along a line drawing an open loop. In this case, a part of the first inner panel 121 may be bent toward the first flow path 10P and form the first slit 10SL. That is, a first guide part 121*a*, a first bending part 121*b* and a first inlet part 121*c* which are described later may be formed as one body. Meanwhile, the first slit 10SL may be referred to as a first cutout.

In this case, the first inner panel 121 may include a first bending part 121*b* bent toward the first flow path 10P as a part of the first inner panel 121, a first guide part 121*a* and a first inlet part 121*c*. Meanwhile, the first guide part 121*a* may be referred to as a first front part, and the first inlet part 121*c* may be referred to as a first rear part.

The first guide part 121*a* may be smoothly connected to the first bending part 121*b* in front of the first bending part 121*b*. The first inlet part 121*c* may be spaced rearward from the first bending part 121*b*. That is, the first bending part 121*b* may be bent from the first guide part 121*a* toward the first flow path 10P and may be separated from the first inlet part 121*c*. In addition, the first guide part 121*a* and the first inlet part 121*c* may have a convex surface to the right, and may define a part of the boundary of the space S. In addition, the first slit 10SL may be formed between the first bending part 121*b* and the first inlet part 121*c*.

In the front-rear direction, a width of the first guide part 121*a* may be greater than a width of the first inlet part 121*c*. For example, in the front-rear direction, the width of the first guide part 121*a* may be four or more times greater than the width of the first inlet part 121*c*.

Meanwhile, a first spacer 15 may be positioned in the first opening LO and may be coupled to the first bending part 121*b* and the first inlet part 121*c*. For example, the first spacer 15 may include a plurality of first spacers 15 spaced apart from each other in a length direction of the first opening LO. Accordingly, a position of the first bending part 121*b* with respect to the first inlet part 121*c* may be fixed by the first spacer 15. In addition, the first spacer 15 may improve rigidity of the first inlet part 121*c* and the first bending part 121*b*. In this case, it may be desirable to minimize the flow resistance of air passing through the first opening LO by designing a small thickness of the first spacer 15 in the up-down direction. Meanwhile, the first spacer 15 may be referred to as a first horizontal rib.

The second connecting member 23 may extend inclined to the right toward the rear from the second inner wall 211. In addition, the second connecting member 23 may be adjacent to the second rear end 20R of the second upper body 20 and spaced apart from the second outer wall 212. In this case, a part of a second opening RO may be positioned between the second connecting member 23 and the second outer wall 212 and may be formed to be inclined to the left toward the front. Here, the second opening RO may communicate with the second flow path 20P. Meanwhile, the second opening RO may be referred to as a second discharge port or a second mouth.

Accordingly, the air flowing through the second flow path 20P may be guided rearward by the second vanes 26 and may be introduced into an inlet of the second opening RO.

A second slit 20SL may be adjacent to the second rear end 20R of the second upper body 20 and may be formed to penetrate the second inner panel 221. The second slit 20SL may be elongated along the second rear end 20R of the second upper body 20. The second slit 20SL may be an outlet of the second opening RO. Accordingly, the second slit 20SL may discharge air flowing through the second flow path 20P into the space S.

For example, a part of the second inner panel 221 may be adjacent to the second rear end 20R of the second upper body 20 and may be cut from the rest of the second inner panel 221 along a line drawing an open loop. In this case, a part of the second inner panel 221 may be bent toward the second flow path 20P and form the second slit 20SL. Meanwhile, the second slit 20SL may be referred to as a second cutout.

In this case, the second inner panel 221 may include a second bending part 221*b* bent toward the second flow path 20P as a part of the second inner panel 221, a second guide part 221*a* and a second inlet part 221*c*. Meanwhile, the second guide part 221*a* may be referred to as a second front part, and the second inlet part 121*c* may be referred to as a second rear part.

The second guide part 221*a* may be connected to the second bending part 221*b* in front of the second bending part 221*b*. The second inlet part 221*c* may be spaced rearward from the second bending part 221*b*. That is, the second bending part 221*b* may be bent from the second guide part 221*a* toward the second flow path 20P and may be separated from the second inlet part 221*c*. In addition, the second guide part 221*a* and the second inlet part 221*c* may have a convex surface to the left, and may define a part of the boundary of the space S. In addition, the second slit 20SL may be formed between the second bending part 221*b* and the second inlet part 221*c*.

In the front-rear direction, a width of the second guide part 221*a* may be greater than a width of the second inlet part 221*c*. For example, in the front-rear direction, the width of the second guide part 221*a* may be four or more times greater than the width of the second inlet part 221*c*.

Meanwhile, a second spacer 25 may be positioned in the second opening RO and may be coupled to the second bending part 221*b* and the second inlet part 221*c*. For example, the second spacer 25 may include a plurality of second spacers 25 spaced apart from each other in a length direction of the second opening RO. Accordingly, a position of the second bending part 221*b* with respect to the second inlet part 221*c* may be fixed by the second spacer 25. In addition, the second spacer 25 may improve rigidity of the second inlet part 221*c* and the second bending part 221*b*. In this case, it may be desirable to minimize the flow resistance of air passing through the second opening RO by designing a small thickness of the second spacer 25 in the up-down direction. Meanwhile, the second spacer 25 may be referred to as a second horizontal rib.

For example, the first connecting member 13 and the second connecting member 23 may be symmetrical left and right, and the first slit 10SL and the second slit 20SL may face each other.

In this case, the first opening LO may be formed to be inclined or bent toward the front of the second slit 20SL. In addition, the second opening RO may be formed to be inclined or bent toward the front of the first slit 10SL. Meanwhile, the first slit 10SL and the second slit 20SL may be hidden from a user's gaze looking from the front to the rear of the blower 1 (refer to FIG. 1).

First ribs 1111 may protrude outward from an outer surface of the first inner wall 111 to contact or be coupled to an inner surface of the first inner panel 121. In this case, the first ribs 1111 may support the first inner panel 121. Second ribs 2111 may protrude outward from an outer surface of the second inner wall 211 to contact or be coupled to an inner surface of the second inner panel 221. In this case, the second ribs 2111 may support the second inner panel 221.

Figure 8:
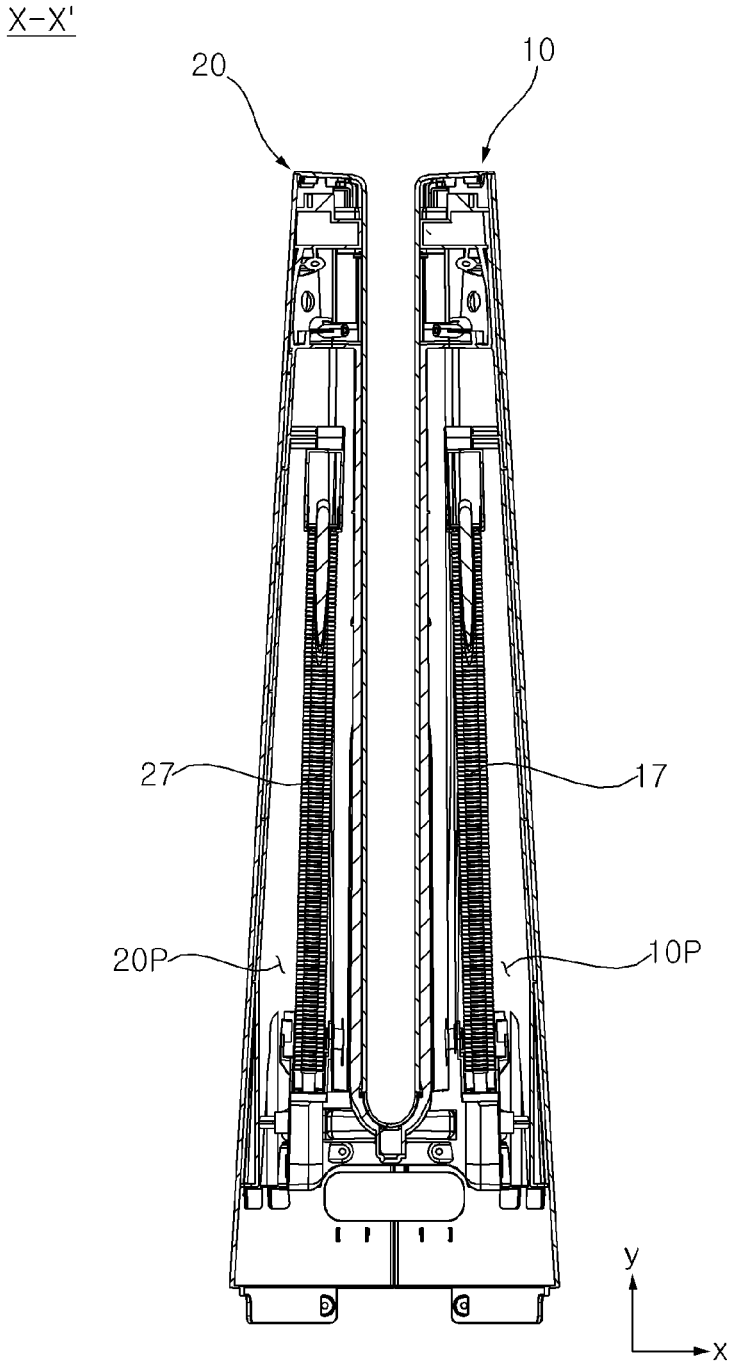
FIG. 8 is a cross-sectional view taken along line X-X' of FIG. 1 and is a longitudinal cross-sectional view of a blower according to another embodiment of the present disclosure.
Figure 9:
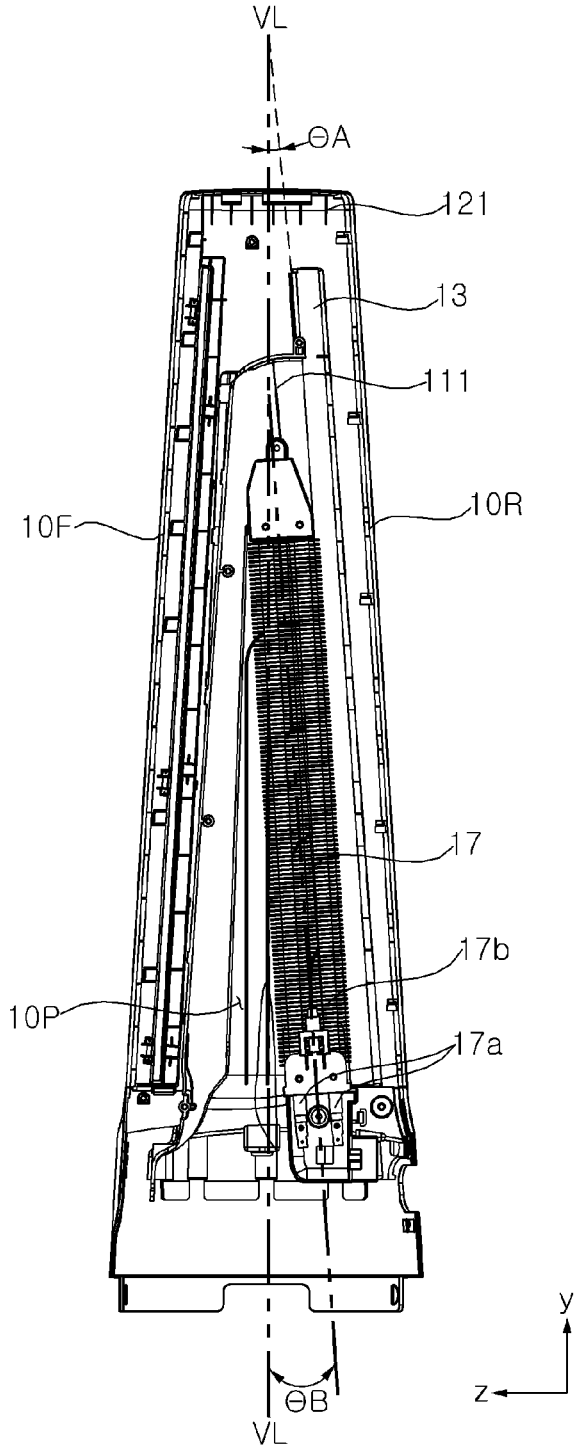
FIG. 9 is a left side view illustrating a state in which a first outer panel is removed from a first upper body of a blower according to another embodiment of the present disclosure.

Referring to FIGS. 8 and 9, the blower 1 may include heaters 17 and 27. A first heater 17 may be installed in the first flow path 10P of the first upper body 10 to increase the temperature of air flowing through the first flow path 10P. A second heater 27 may be installed in the second flow path 20P of the second upper body 20 to increase the temperature of air flowing through the second flow path 20P. At this time, the control unit 5 (refer to FIG. 2) may be electrically connected to the first heater 17 and the second heater 27 and may control the operation of the first heater 17 and the second heater 27.

For example, the first heater 17 and the second heater 27 may be electric heating instruments using a heating action of electric current. For another example, the first heater 17 and the second heater 27 may be heat exchangers using heat of condensation of a high-temperature refrigerant.

The first heater 17 may be generally formed in a rectangular parallelepiped shape and may be elongated along the first connecting member 13. Here, a longitudinal direction of the first connecting member 13 is the same as a longitudinal direction of the aforementioned first slit 10SL (refer to FIG. 7), and the first connecting member may be inclined forward by a first angle theta A with respect to a vertical line VL extending in the up-down direction. In addition, a longitudinal direction of the first heater 17 may be inclined by a second angle theta B forward with respect to the vertical line VL. In this case, the second angle theta B may be the same as or similar to the first angle theta A.

In this case, the first heater 17 may include a coil through which current flows, or a first tube 17*a* through which high-temperature refrigerant flows. The first tube 17*a* may extend long in a longitudinal direction of the first heater 17.

And the first heater 17 may include a plurality of first fins 17*b* coupled to an outer circumferential surface of the first tube 17*a* and spaced apart from each other in a longitudinal direction of the first tube 17*a* to provide a flow path of air. For example, each of the plurality of first fins 17*b* may extend in a direction intersecting or perpendicular to the longitudinal direction of the first tube 17*a*. For another example, each of the plurality of first fins 17*b* may be formed to be convex upward and may have a rear end positioned at a relatively upper side and a front end positioned at a relatively lower side.

Meanwhile, the first heater 17 and the second heater 27 may be symmetrical left and right. That is, the description of the first heater 17 may be equally applied to the second heater 27.

Accordingly, the first heater 17 may not only heat the air flowing through the first flow path 10P, but also may smoothly guide the air rising in the first flow path 10P to the rear. In addition, the second heater 27 may not only heat the air flowing through the second flow path 20P, but also may smoothly guide the air rising in the second flow path 20P to the rear.

Figure 10:
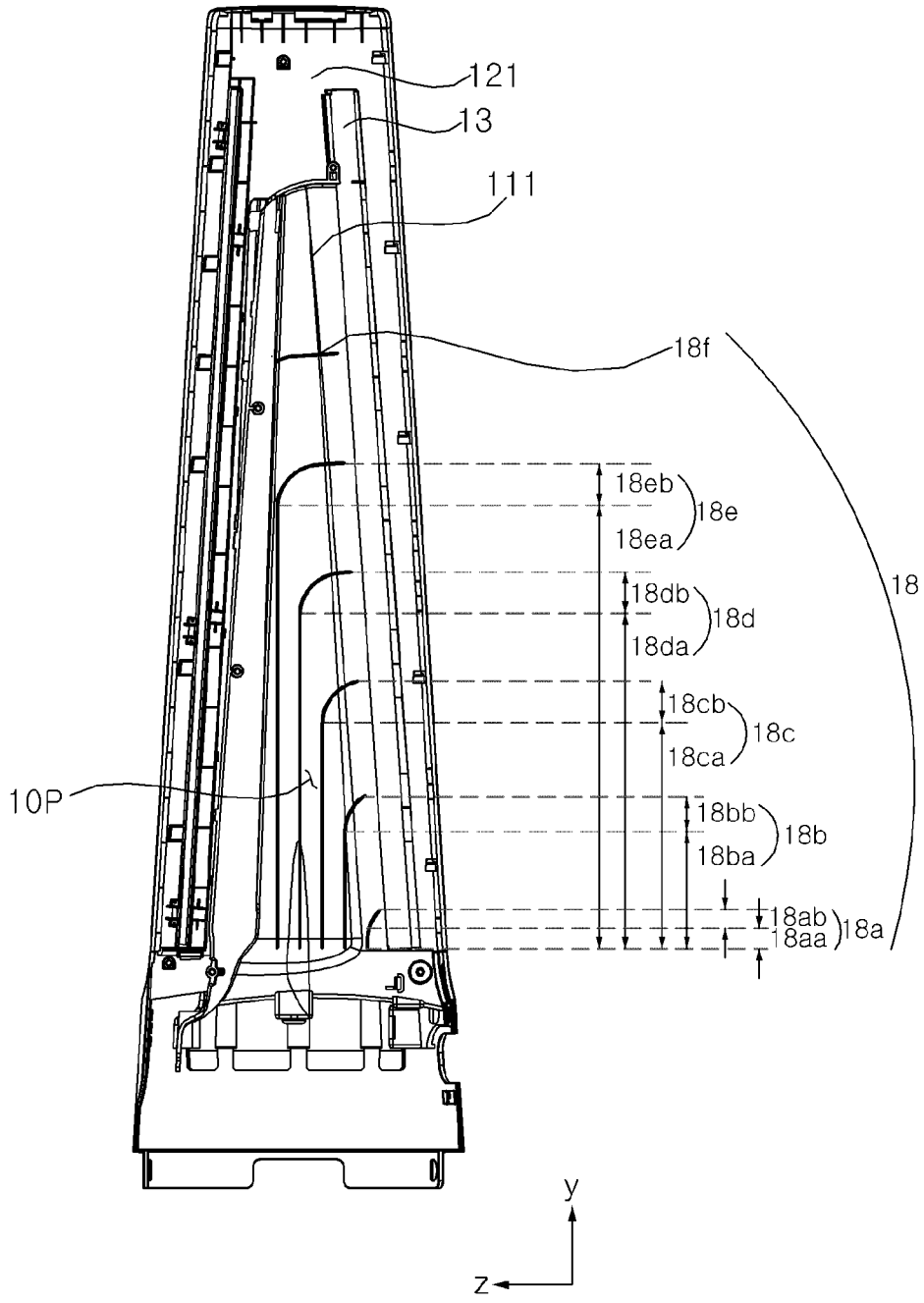
FIG. 10 is a left side view illustrating a state in which a first outer panel and a first outer wall are removed from a first upper body of a blower according to another embodiment of the present disclosure.

Referring to FIGS. 9 and 10, the first heater 17 may be detachable inside the first inner wall 111. For example, the first heater 17 may be detachably coupled to an inside of the first inner wall 111 through screw fastening or snap fit fastening.

A first protrusion 18 may protrude from an inside of the first inner wall 111 toward the first flow path 10P. The first protrusion 18 may be disposed between the first heater 17 and the inside of the first inner wall 111. The first protrusion 18 may include a first vertical part extending in up-down direction and a first curved part bent rearward or in a direction from an upper end of the vertical part toward the first connecting member 13. In this case, an end of the first vertical part may form a lower end of the first protrusion 18, and an end of the first curved part may form an upper end of the first protrusion 18. In addition, the upper end of the first protrusion 18 may be adjacent to the first connecting member 13. For example, the first protrusion 18 may include a plurality of first protrusions 18*a*, 18*b*, 18*c*, 18*d*, 18*e*, and 18*f* spaced apart from each other in the front-rear direction.

A 1-1 protrusion 18*a* may include a 1-1 vertical part 18*aa* having an end spaced forward from a lower end of the first connecting member 13 and a 1-1 curved part 18*ab* bent toward the first connecting member 13 from the 1-1 vertical part 18*aa*.

A 1-2 protrusion 18*b* may include a 1-2 vertical part 18*ba* having an end spaced forward from the end of the 1-1 vertical part 18*aa* and a 1-2 curved part 18*bb* bent toward the first connecting member 13 from the 1-2 vertical part 18*ba*. In this case, a length of the 1-2 vertical part 18*ba* may be greater than a length of the 1-1 vertical part 18*aa* and a length of the 1-2 curved part 18*bb* may be greater than a length of the 1-1 curved part 18*ab*.

A 1-3 protrusion 18*c* may include a 1-3 vertical part 18*ca* having an end spaced forward from the end of the 1-2 vertical part 18*ba* and a 1-3 curved part 18*cb* bent toward the first connecting member 13 from the 1-3 vertical part 18*ca*. In this case, a length of the 1-3 vertical part 18*ca* may be greater than the length of the 1-2 vertical part 18*ba*, and a length of the 1-3 curved part 18*cb* may be greater than the length of the 1-2 curved part 18*bb*.

A 1-4 protrusion 18*d* may include a 1-4 vertical portion 18*da* having an end spaced forward from the end of the 1-3 vertical part 18*ca* and a 1-4 curved part 18*da* bent toward the first connecting member 13 from the 1-4 vertical part 18*da*. In this case, a length of the 1-4 vertical part 18*da* may be greater than the length of the 1-3 vertical part 18*ca*, and a length of the 1-4 curved part 18*db* may be greater than the length of the 1-3 curved part 18*cb*.

A 1-5 protrusion 18*e* may include a 1-5 vertical part 18*ea* having an end spaced forward from the end of the 1-4 vertical part 18*da* and a 1-5 curved part 18*eb* bent toward the first connecting member 13 from the 1-5 vertical part 18*ea*. In this case, a length of the 1-5 vertical part 18*ea* may be greater than the length of the 1-4 vertical part 18*da*, and a length of the 1-5th curved part 18*eb* may be greater than the length of the 1-5 curved part 18*db*.

A 1-6 protrusion 18*f* may be positioned above the 1-5 curved part 18*eb* and may be convex upward or extend obliquely toward the first connecting member 13.

On the other hand, a second protrusion 28 (not shown) may protrude from an inside of the second inner wall 211 toward the second flow path 20P, and the above description for the first protrusion 18 may be applied in the same manner.

Accordingly, the first protrusion 18 may more smoothly guide the air rising in the first flow path 10P together with the first heater 17 to the rear. In addition, the second protrusion 28 may more smoothly guide the air rising in the second flow path 20P together with the second heater 27 to the rear.

Figure 11:
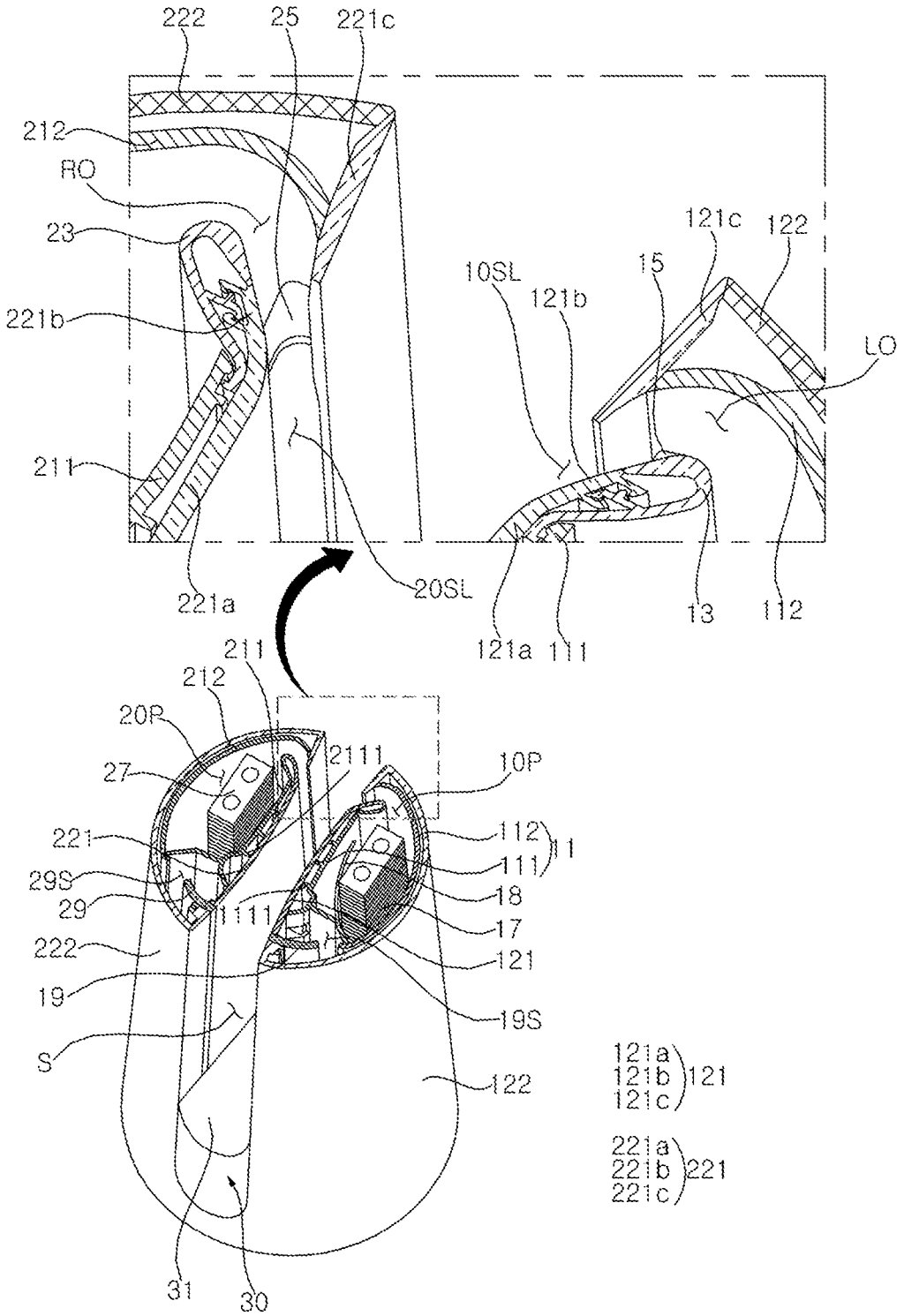
FIG. 11 is a perspective view illustrating an internal configuration of a blower according to another embodiment of the present disclosure by cutting out parts of a first upper body and a second upper body.

Referring to FIG. 11, the first heater 17 may be adjacent to the first connecting member 13, and air may be introduced into the first opening LO through the first heater 17. The second heater 27 may be adjacent to the second connecting member 23, and air may be introduced into the second opening RO through the second heater 27.

Accordingly, when the first heater 17 is operated, the first slit 10SL may discharge air flowing through the first flow path 10P and heated by the first heater 17 to the space S. In addition, when the second heater 27 is operated, the second slit 20SL may discharge air flowing through the second flow path 20P and heated by the second heater 27 into the space S. Meanwhile, the first heater 17 may be positioned between the first inner wall 111 and the first outer wall 112, and may be spaced apart from the first inner wall 111 and the first outer wall 112. The second heater 27 may be positioned between the second inner wall 211 and the second outer wall 212, and may be spaced apart from the second inner wall 211 and the second outer wall 212. The double structure of the upper body 10 and 20 having the walls 11 and 21 and the panels 12 and 22 may reduce a transfer of heat from the heaters 17 and 27 to the panels 12 and 22 through the walls 11 and 21. In addition, an air gap may be formed between the first inner wall 111 and the first inner panel 121 by the first ribs 1111, an air gap may be formed between the second inner wall 211 and the second inner panel 221 by the second ribs 2111. The air gap may reduce a transfer of heat from the heaters 17 and 27 from the walls 11 and 21 to the panels 12 and 22.

Figure 12:
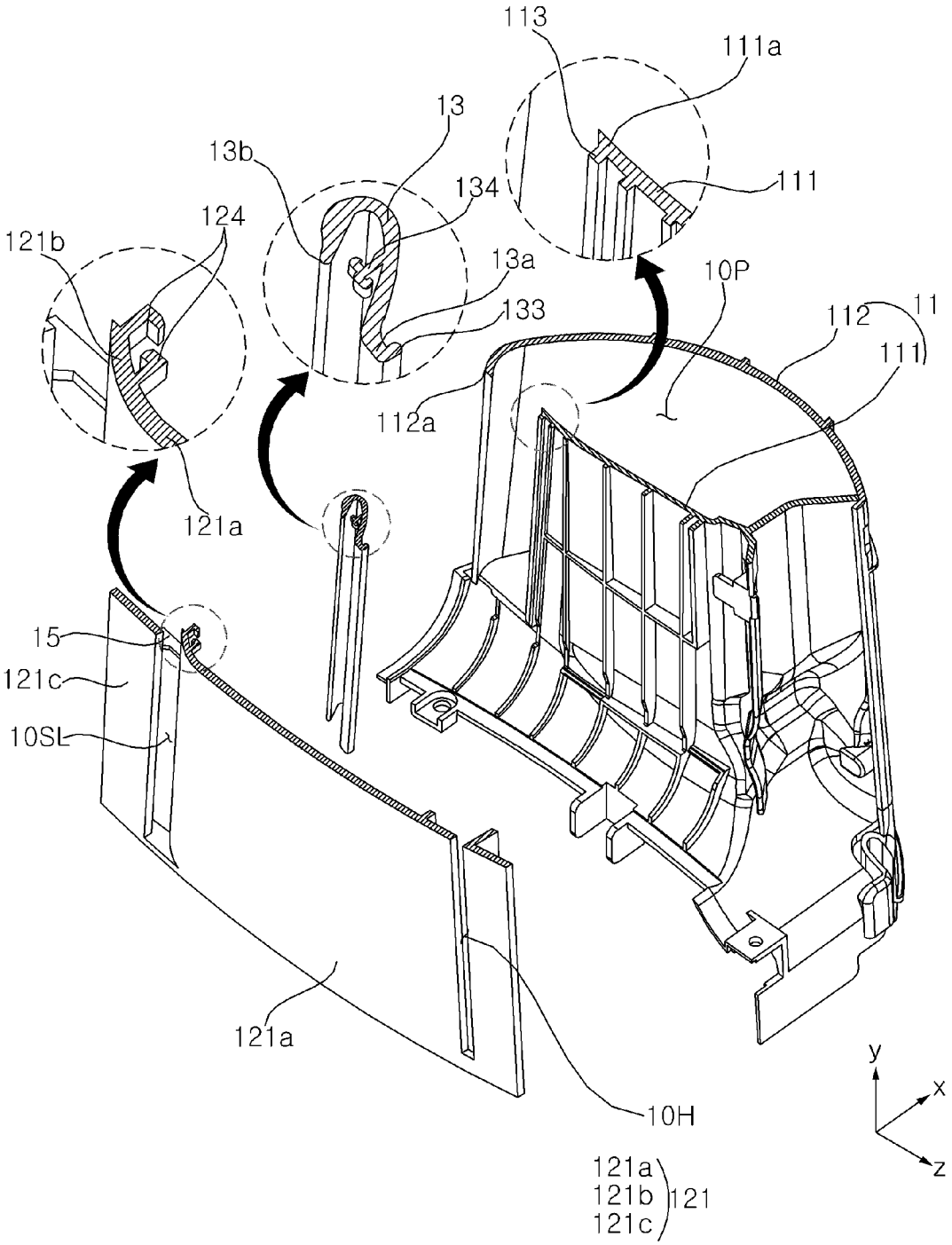
FIGS. 12 to 14 are views for explaining a process of assembling and disassembling a first wall, a first connecting member, and a first inner panel according to embodiments of the present disclosure.
Figure 13:
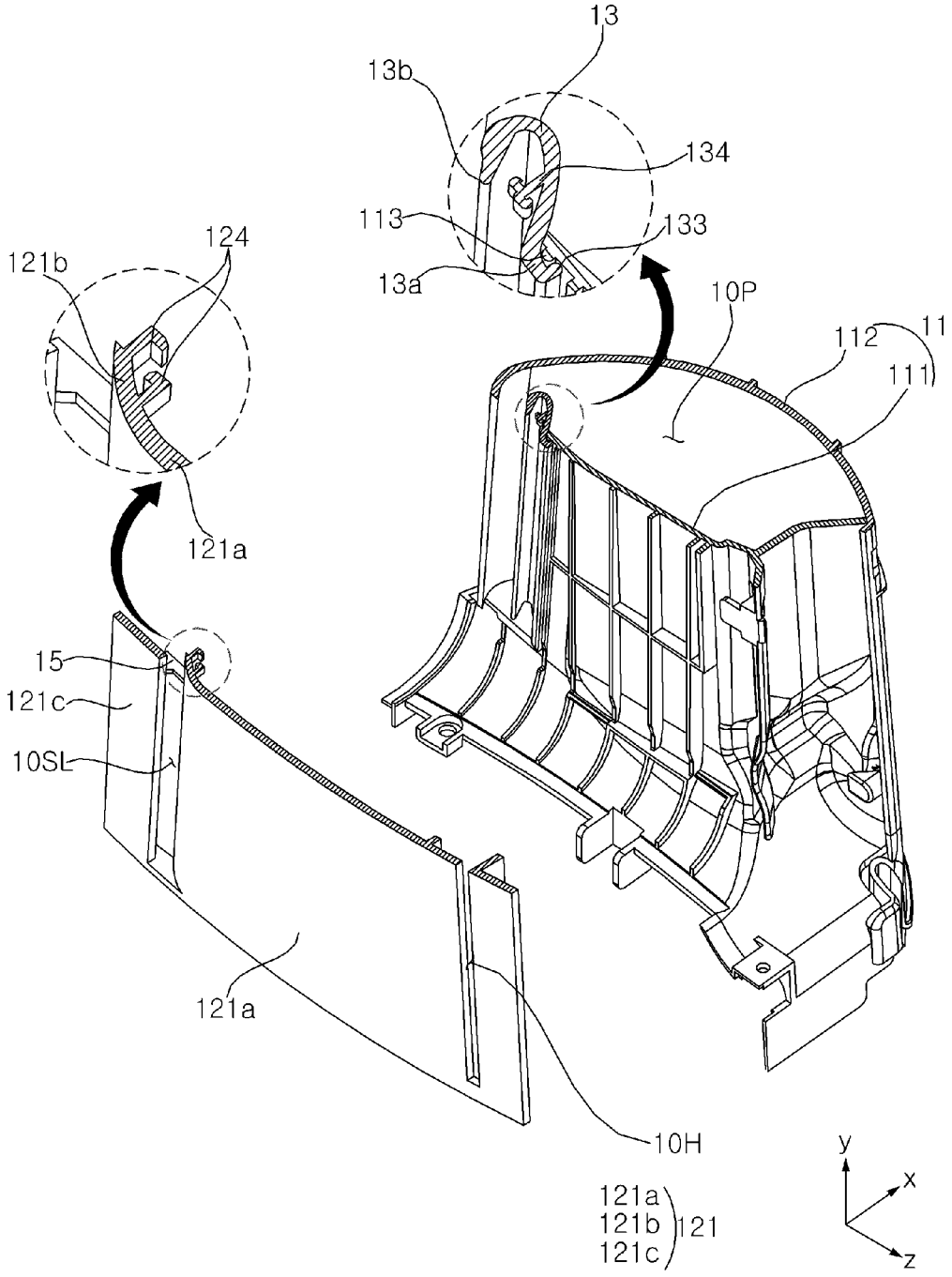
Figure 14:
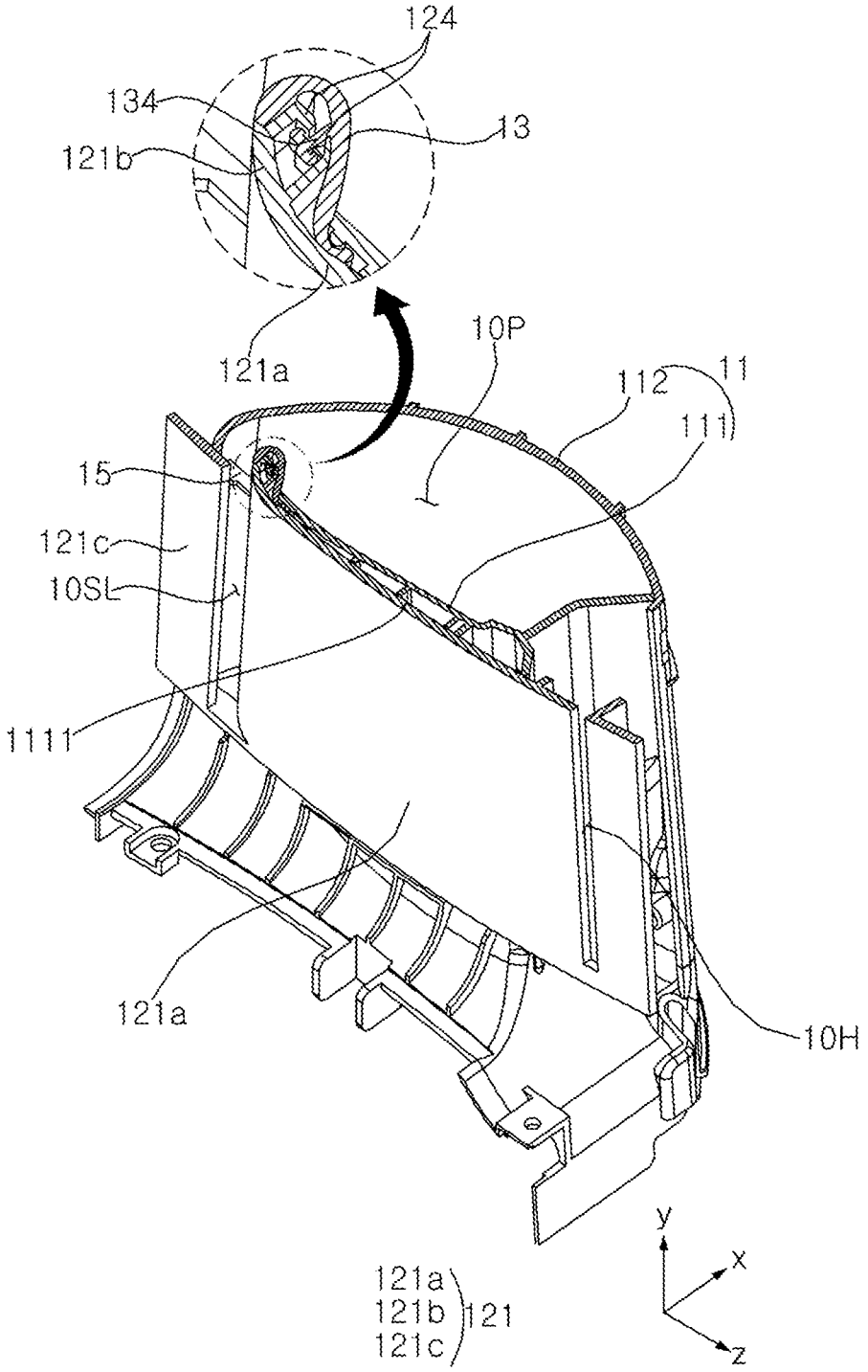

Referring to FIGS. 12 to 14, the first wall 11, the first connecting member 13, and the first inner panel 121 may be detachably coupled to each other. In this case, an end 111*a* of the first inner wall 111 and an end 112*a* of the first outer wall 112 may be spaced apart from each other. Here, the end 111*a* of the first inner wall 111 may form one end of the first wall 11, and the end 112*a* of the first outer wall 112 forms the other end of the first wall 11. In addition, at least a part of the first bending part 121*b* may be disposed between the end 111*a* of the first inner wall 111 and the end 112*a* of the first outer wall 112.

The first connecting member 13 may be disposed between the end 111*a* of the first inner wall 111 and the first bending part 121*b* and connected to the first inner wall 111 and the first bending part 121*b*. Meanwhile, unlike as described above and described later, the first connecting member 13 may be provided integrally with the first inner wall 111 or may be provided integrally with the first bending part 121*b*.

Referring to FIGS. 12 and 13, the first connecting member 13 may be detachably coupled to the first inner wall 111. For example, a first hook 133 may protrude toward the first inner wall 111 from one end 13*a* of the first connecting member 13, and a first locking part 113 may protrude toward the first inner panel 121 from the end 111*a* of the first inner wall 111. Accordingly, the first connecting member 13 may be detachably coupled to the first inner wall 111 through hook coupling between the first hook 133 and the first locking part 113.

Referring to FIGS. 13 and 14, the first inner panel 121 may be detachably coupled to the first connecting member 13. For example, a second hook 124 may protrude toward the first connecting member 13 from an inner surface of the first bending part 121*b*, and a second locking part 134 may protrude toward the first bending part 121*b* between one end 13*a* and the other end 13*b* of the first connecting member 13. Accordingly, the first inner panel 121 may be detachably coupled to the first connecting member 13 through hook coupling between the second hook 124 and the second locking part 134.

Accordingly, shapes of the first inner wall 111 and the first outer wall 112 of the first wall 11 may be designed to smoothly guide air to the first opening LO while minimizing the flow resistance of air flowing through the first flow path 10P. In addition, the shape of the first inner panel 121 may be designed to smoothly guide the air flowing through the space (S, see FIG. 11) in accordance with the desired airflow by the user. That is, the first wall 11 and the first inner panel 121 may be separately formed according to the respective design purposes.

And, as described above, each of the first inner wall 111, the first outer wall 112, the first connecting member 13, and the first inner panel 121 may be manufactured separately and may be easily assembled. In addition, maintenance and cleaning such as removing foreign substances such as dust attached to the first inner panel 121 and/or the first connecting member 13 may be easily performed by separating the first inner panel 121 and/or the first connecting member 13 from the first inner wall 111.

Meanwhile, the second hook 124 and the second locking part 134 coupled to each other may function as a rigid member for the first connecting member 13 and the first bending part 121*b*. That is, the second hook 124 and the second locking part 134 may improve torsional rigidity and/or flexural rigidity of the first connecting member 13 and the first bending part 121*b*. Also, as described above, since a position of the first bending part 121*b* with respect to the first inlet part 121*c* may be fixed by the first spacer 15, a position of the first connecting member 13 coupled to the first bending part 121*b* may be also fixed.

Accordingly, vibration or noise of the first connecting member 13 due to the flow of air may be minimized. As described above with reference to FIG. 6 and the like, the first connecting member 13 may be connected to the first vane 16 coupled to the first inner wall 111 and/or the first outer wall 112. The first vane 16 may support the first connecting member 13, and may improve rigidity of the first connecting member 13. For example, the plurality of first vanes 16 and the plurality of first spacers 15 may be alternately disposed with the first connecting member 13 interposed therebetween. In this case, in the longitudinal direction of the first connecting member 13, the rigidity of the first connection member 13 and the first bending part 121*b* connected thereto may be strengthened as a whole.

Meanwhile, the above-described contents may be equally applied to the second wall 21, the second connecting member 23, and the second inner panel 221.

Referring to FIGS. 15 to 18, the second connecting member 23 may be formed in the shape of an airfoil or a long S-shaped hook as a whole. The second connecting member 23 may include a first part 231, a second part 232, and a third part 233. Here, an end 211*a* of the second inner wall 211 may form one end of the second wall 21, and an end 212*a* of the second outer wall 212 may form the other end of the second wall 21. Meanwhile, the above-described and later-described contents may be similarly applied to the first opening LO, the first connecting member 13, and the first inner panel 121.

One end of the first part 231 may form one end 23*a* of the second connecting member 23. At this time, one end 23*a* of the second connecting member 23 may be disposed between the first inner wall 211 and the first guide part 221*a*. The first part 231 may be obliquely extended rearward toward the first flow path 10P. In other hands, the first part 231 may be inclined to the right with respect to an imaginary straight line (not shown) extending in the front-rear direction, and one end and the other end of the first part 231 may be formed to be curved.

One end of the second part 232 may be connected to the other end of the first part 231 and may be bent toward the second opening RO from the other end of the first part 231. The second part 232 may extend by drawing an arc with a first radius R1 with respect to a center C positioned inside the second connecting member 23.

One end of the third part 233 may be connected to the other end of the second part 232, and the other end of the third part 233 may form the other end 23*b* of the second connecting member 23. The third part 233 may extend from the other end of the second part 232 toward the second bending part 221*b*. In this case, the other end 23*b* of the second connecting member 23 may be connected to the end of the second bending part 221*b*. A surface of the third part 233 may be smoothly connected to a surface of the second bending part 221*b*.

Meanwhile, a part of the second outer wall 212 may be positioned behind the second connecting member 23, and the end 212*a* of the second outer wall 212 may be connected to the inside of the second inlet part 221*c*. A part of the second outer panel 222 may be positioned behind the second outer wall 212, and an end 222*a* of the second outer panel 222 may be connected to the second inlet part 221*c*. At this time, a front part 221*ca* of the second inlet part 221*c* may protrude from the end 212*a* of the second outer wall 212 toward the second bending part 221*b*, and have an inner surface facing the third part 233. In addition, a length of the front part 221*ca* may be greater than a length of the third part 233.

In this case, the second opening RO may be formed between the second part 232, the third part 233, and the second bending part 221*b*, the second outer wall 212, and the front part 221*ca*.

In other words, the second part 232, the third part 233, and the second bending part 221*b* may define a front boundary of the second opening RO, and the second outer wall 212 and the front part 221*ca* may define a rear boundary of the second opening RO.

In addition, the inlet of the second opening RO may be formed between one end of the second part 232 and the second outer wall 212. The outlet of the second opening RO may be formed between a part of the second bending part 221*b* connected to the second guide part 221*a* and the front part 221*ca*. In this case, the outlet of the second opening RO may be provided as the second slit 20SL.

For example, a first gap G1 which is a gap between one end of the second part 232 and the second outer wall 212 may be the same as a second gap G2 which is a gap between the other end of the second part 232 and the second outer wall 212. In addition, a gap between the second part 232 and the second outer wall 212 may be constant between one end and the other end of the second part 232. In this case, the second outer wall 212 may extend while drawing an arc with a second radius R2 with respect to the center C positioned inside the second connecting member 23. Here, the second radius R2 may be larger than the first radius R1, and a center of curvature of the second part 232 and a center of curvature of the second outer wall 212 may be the same. Accordingly, flow resistance or loss of air passing between the second part 232 and the second outer wall 212 may be reduced.

For another example, a first gap G1 which is a gap between one end of the second part 232 and the second outer wall 212 may be larger than a second gap G2 which is a gap between the other end of the second part 232 and the second outer wall 212. In addition, a gap between the second part 232 and the second outer wall 212 may decrease from one end of the second part 232 to the other end. Accordingly, the flow velocity of air passing between the second part 232 and the second outer wall 212 may be increased.

Meanwhile, a section positioned between the second part 232 and the second outer wall 212 as a part of the second opening RO may be referred to as a curved section ROa. Air flowing backward from the second flow path 20P may be introduced into the inlet of the second opening RO (see A in), and the flow direction of the air may pass through the curved section ROa and may be switched forward.

Meanwhile, a gap between one end of the third part 233 and the front part 221*ca* may be the same as the second gap G2.

Figure 15:
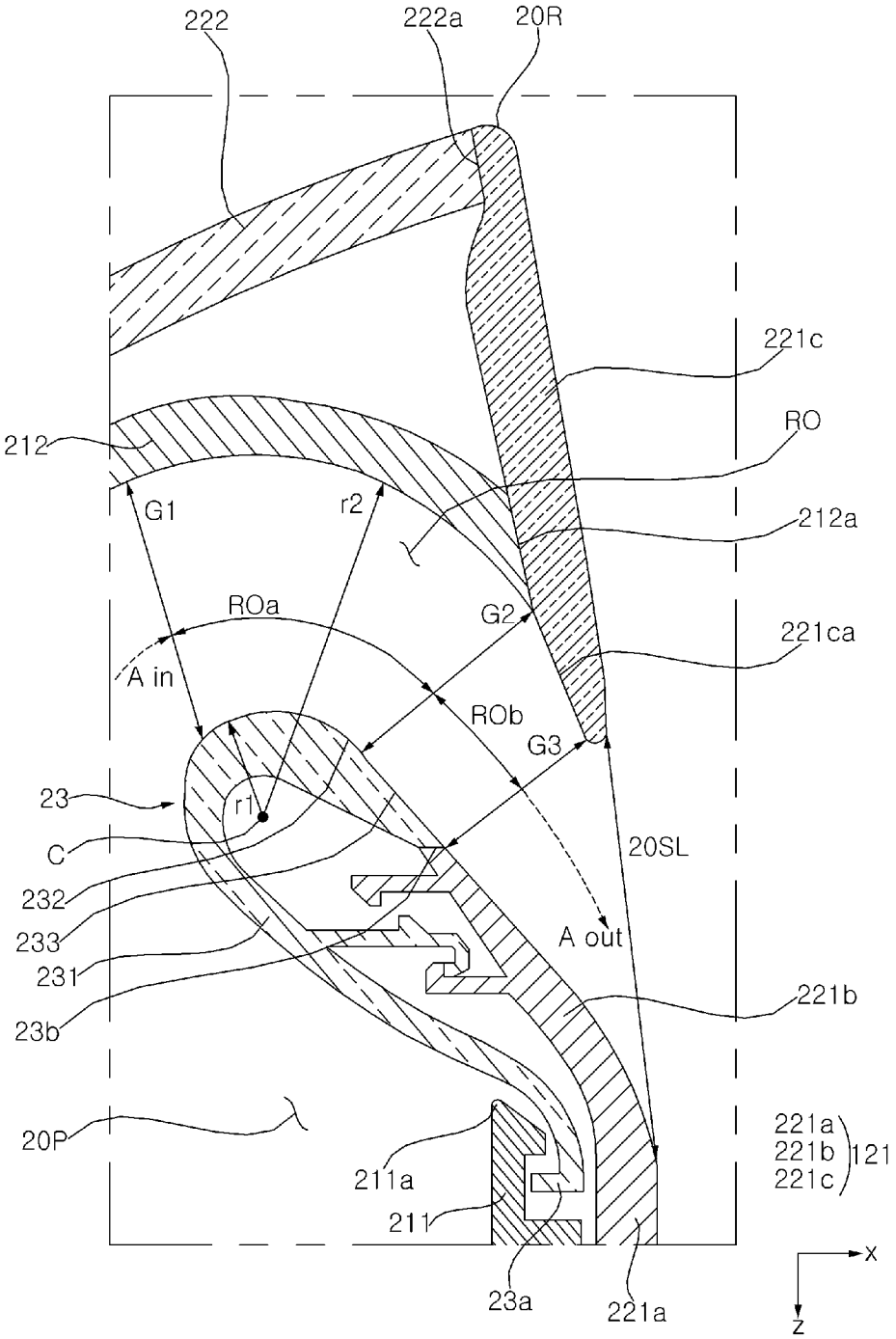
FIGS. 15 to 18 are views for explaining configurations defining a second opening and a boundary thereof according to embodiments of the present disclosure.

Referring to FIG. 15, a third gap G3, which is a gap between the other end of the third part 233 and the front part 221*ca*, may be smaller than the second gap G2. In addition, a gap between the third part 233 and the front part 221*ca* may decrease from one end of the third part 233 to the other end. In this case, the inner surface of the front part 221*ca* may be smoothly connected to the second outer wall 212 while facing the third part 233.

Accordingly, the flow velocity of air passing between the third part 233 and the front part 221*ca* may be increased.

Meanwhile, a section positioned between the third part 233 and the front part 221*ca* as a part of the second opening RO may be referred to as a tapered section ROb or a converging section. The tapered section ROb may be positioned downstream of the curved section ROa. The air that has passed through the tapered section ROb may flow along the second bending part 221*b* and pass through the second slit 20SL (see Aout). Further, due to the coanda effect, air discharged from the second slit 20SL may flow forward along the second guide part 221*a*.

Figure 16:
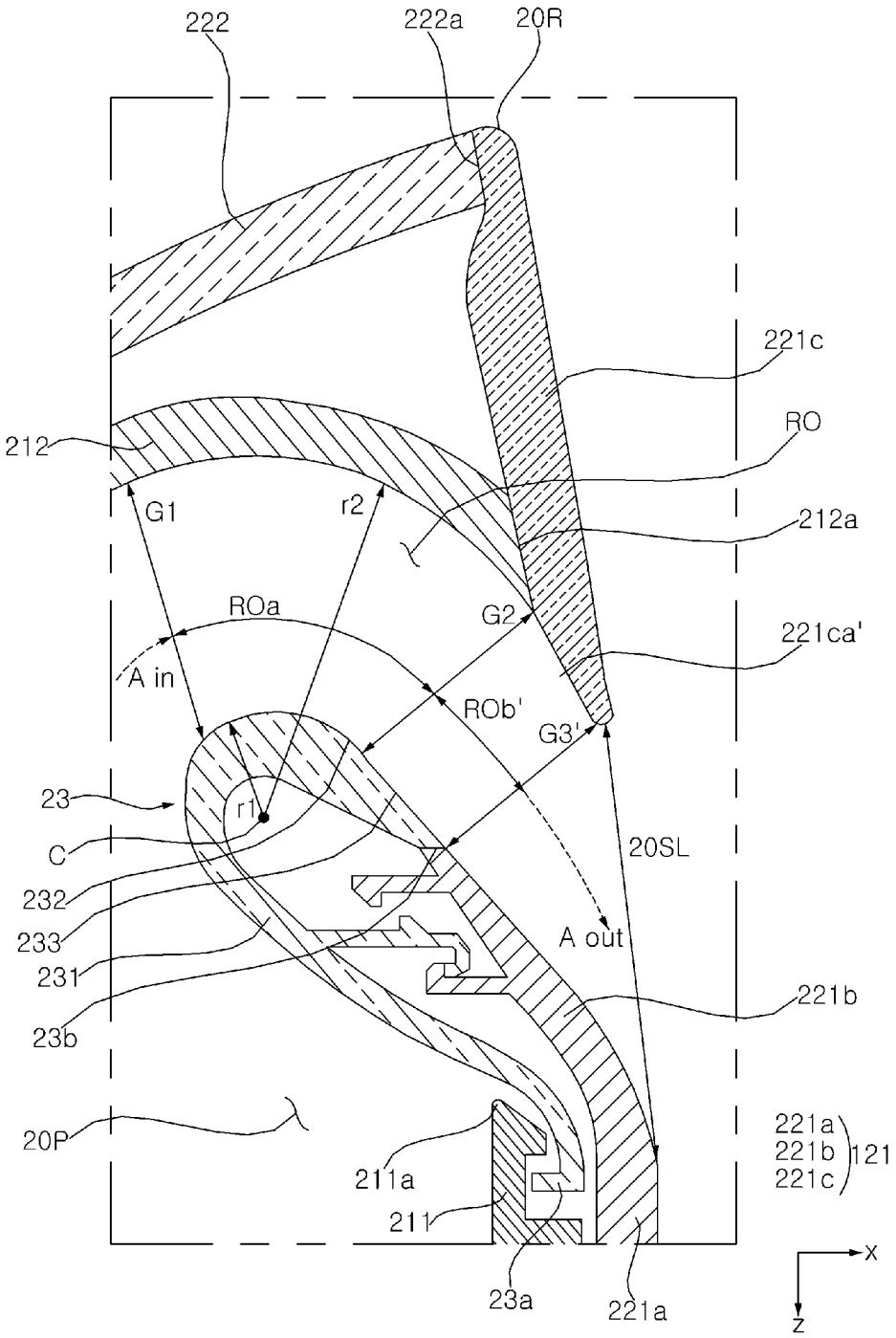

Referring to FIG. 16, a third gap G3', which is a gap between the other end of the third part 233 and a front part 221*ca*', may be the same as the second gap G2. In addition, a gap between the third part 233 and the front part 221*ca*' may be constant between one end and the other end of the third part 233. In this case, an inner surface of the front part 221*ca*' may be smoothly connected to the second outer wall 212 while facing the third part 233. In addition, the inner surface of the front part 221*ca*' may be parallel to the third part 233.

Accordingly, flow resistance or loss of air passing between the third part 233 and the front part 221*ca*' may be reduced.

On the other hand, a section positioned between the third part 233 and the front part 221*ca*' as part of the second opening RO may be referred to as a straight section ROb', or a constant section. The straight section ROb' may be positioned downstream of the curved section ROa. The air that has passed through the straight section ROb' may flow along the second bending part 221*b* and pass through the second slit 20SL (see Aout). Further, due to the coanda effect, air discharged from the second slit 20SL may flow forward along the second guide part 221*a*.

Figure 17:
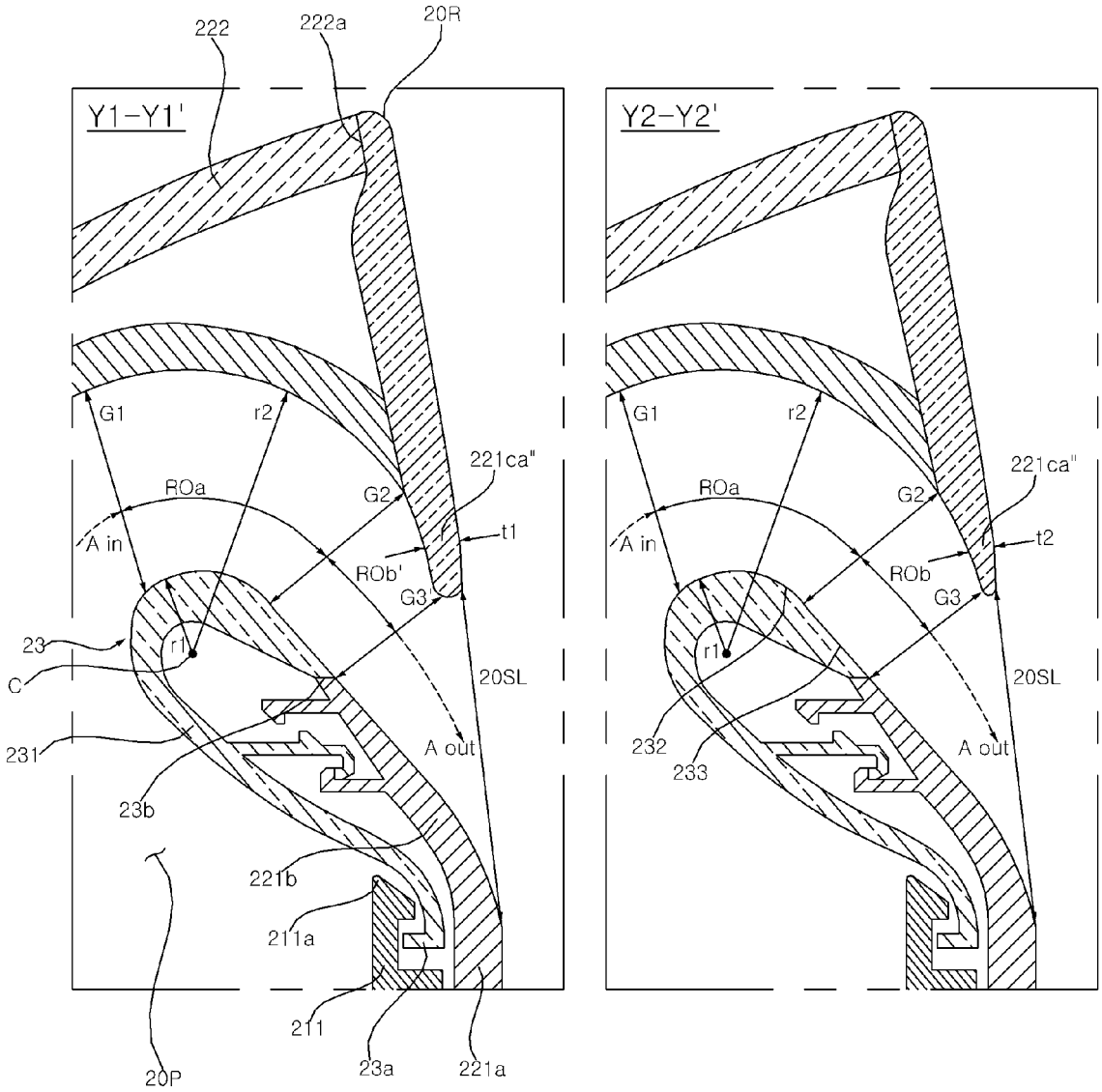

Referring to FIG. 17, a thickness of the front part 221*ca*" may vary according to a position of the front part 221*ca*" with respect to the second spacer 25. Here, the second spacer 25 may be coupled to the second bending part 221*b* and the front part 221*ca*" of the second inlet part 221*c* (see FIGS. 7 and 11). That is, a thickness t1 of a part of the front part 221*ca*" positioned relatively close to the second spacer 25 may be greater than a thickness t2 of a part positioned far from the second spacer 25.

For example, the second spacer 25 may include a plurality of second spacers 25 spaced apart from each other in the length direction of the second opening RO. In this case, the thickness of the front part 221*ca*" may increase as it is adjacent to each of the spacers 25 from a center of the spacers 25 adjacent to each other.

Accordingly, the front part 221*ca*" having a relatively large thickness adjacent to the second spacer 25 may improve the rigidity of the second spacer 25 coupled thereto. In addition, as the thickness of the front part 221*ca*" increases, the gap between the third part 233 and the front part 221*ca*" may decrease.

Figure 18:
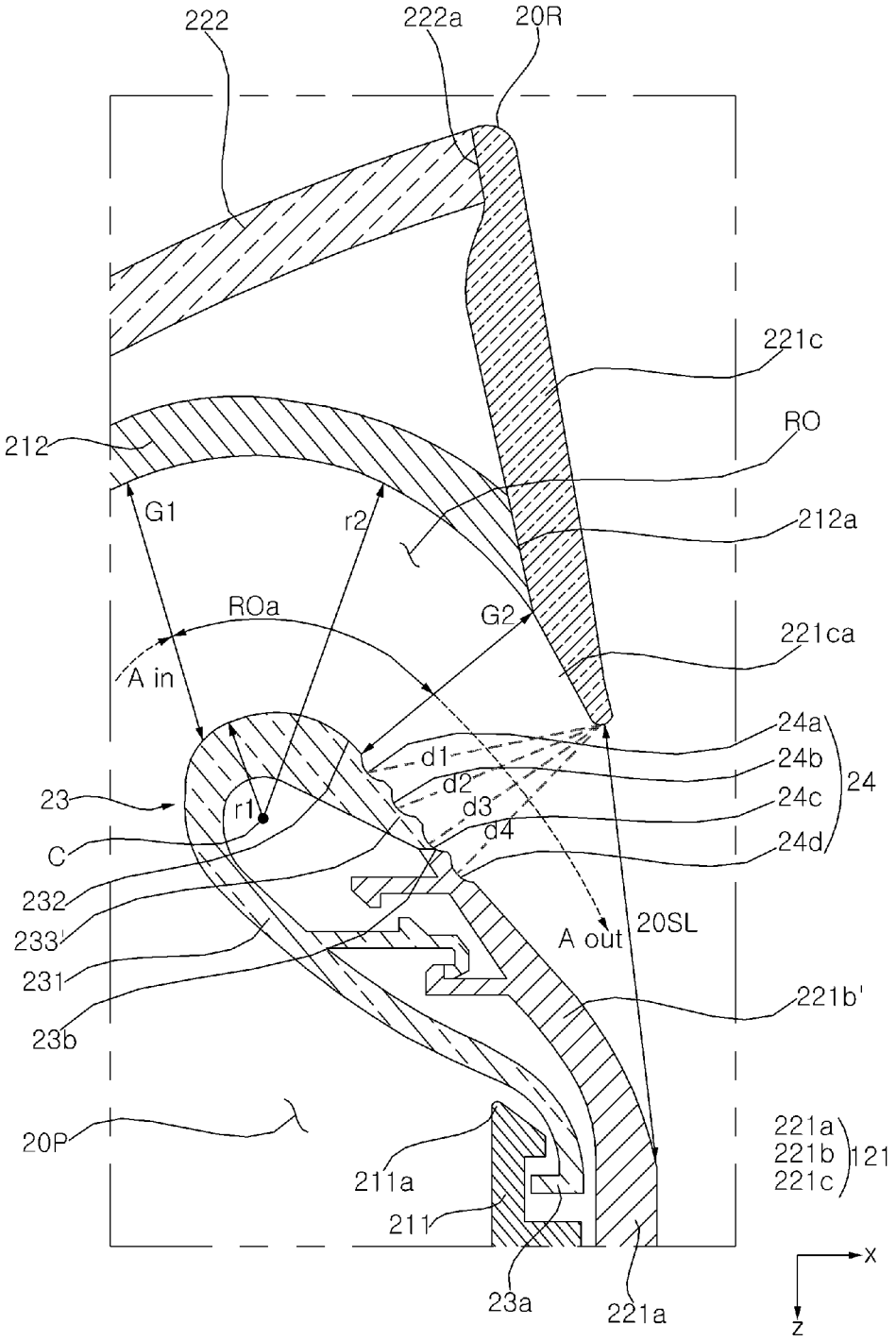

Referring to FIG. 18, a groove 24 may be formed in the third part 233' and/or the second bending part 221*b*'. The groove 24 may be formed while being depressed inward from the third part 233' and/or the second bending part 221*b*'. Meanwhile, the groove 24 may be referred to as a dimple.

For example, the groove 24 may include a plurality of grooves 24 formed by drawing different arcs with respect to different centers. In this case, the plurality of grooves 24 may face the inner surface of the front part 221*ca*. A first groove 24*a* may be adjacent to one end of the third part 233', a second groove 24*b*, a third groove 24*c*, and a fourth groove 24*d* may be placed as sequentially from the first groove 24*a*.

In this case, a gap between the third part 233' and the front part 221*ca* may not be constant. That is, a first distance d1, which is a distance between an end of the front part 221*ca* and the first groove 24*a*, may be greater that a second distance d2, which is a distance between the end of the front part 221*ca* and the second groove 24*b*. In addition, the second distance d2 may be greater than a third distance d3, which is a distance between the end of the front portion 221*ca* and the third groove 24*c*. In addition, the third distance d3 may be greater than a fourth distance d4, which is a distance between the end of the front portion 221*ca* and the fourth groove 24*d*.

Accordingly, a flow characteristic or directionality of air passing between the third part 233' and the front part 221*ca* may be effectively maintained.

Meanwhile, the air that have passed through between the third part 233' and the front part 221*ca* may flow along the second bending part 221*b'* and pass through the second slit 20SL (see Aout). Further, due to the coanda effect, air discharged from the second slit 20SL may flow forward along the second guide part 221*a*.

Figure 19:
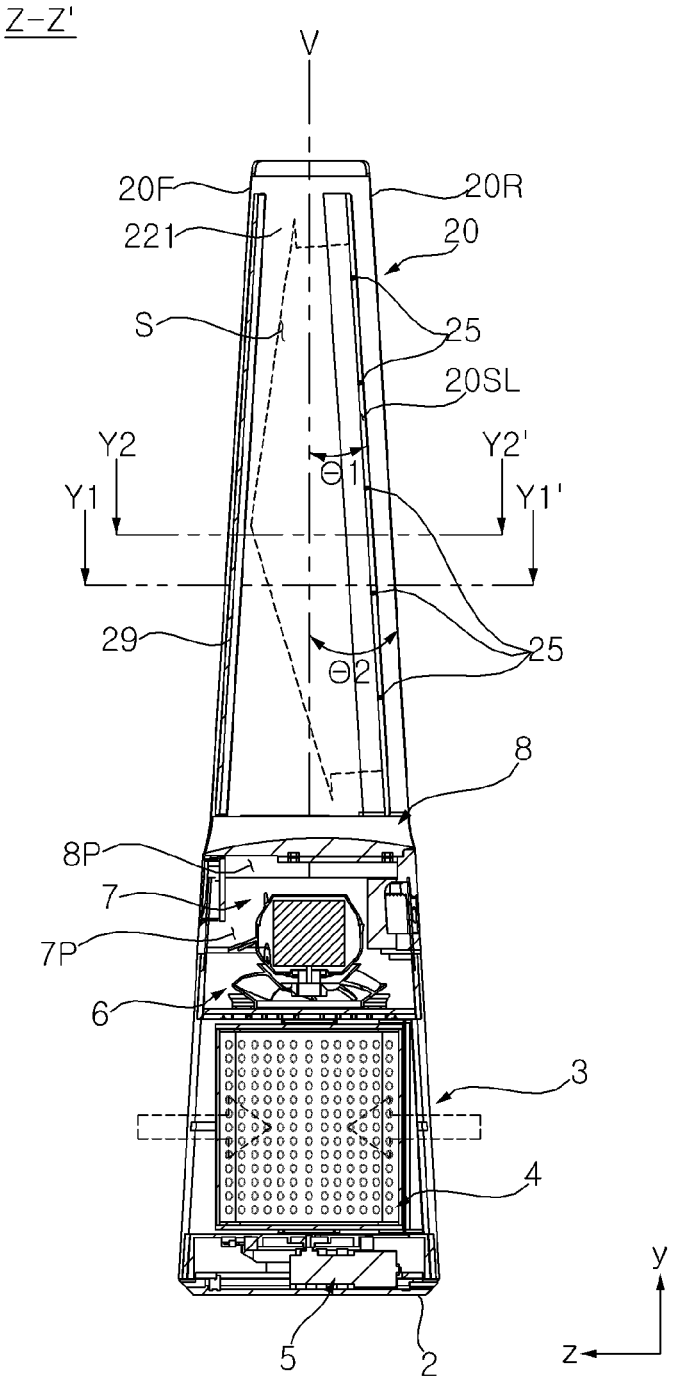
FIG. 19 is a sectional view taken along line Z-Z' of FIG. 1.

Referring to FIG. 19, the second slit 20SL may discharge air flowing through the second flow path 20P (refer to FIGS. 7 and 11) to the space S. The second slit 20SL may be adjacent to the second rear end 20R of the second upper body 20 and may be formed to penetrate through the second inner panel 221. The second slit 20SL may be elongated along the second rear end 20R.

In this case, the second slit 20SL may be formed to be inclined forward at a predetermined angle (acute angle) with respect to a vertical line V extending in the up-down direction.

For example, the second slit 20SL may be parallel to the second rear end 20R. For another example, the second slit 20SL may not be parallel to the second rear end 20R. In this case, the second slit 20SL may be inclined at a first angle (theta 1, for example, 4 degrees) with respect to the vertical line V, and the second rear end 20R may be inclined at a second angle (theta 2, for example, 3 degrees) smaller than the first angle theta 1 with respect to the vertical line V.

Meanwhile, the first slit 10SL (refer to FIGS. 7 and 11) and the second slit 20SL may be symmetrical while facing each other in the left-right direction.

Figure 20:
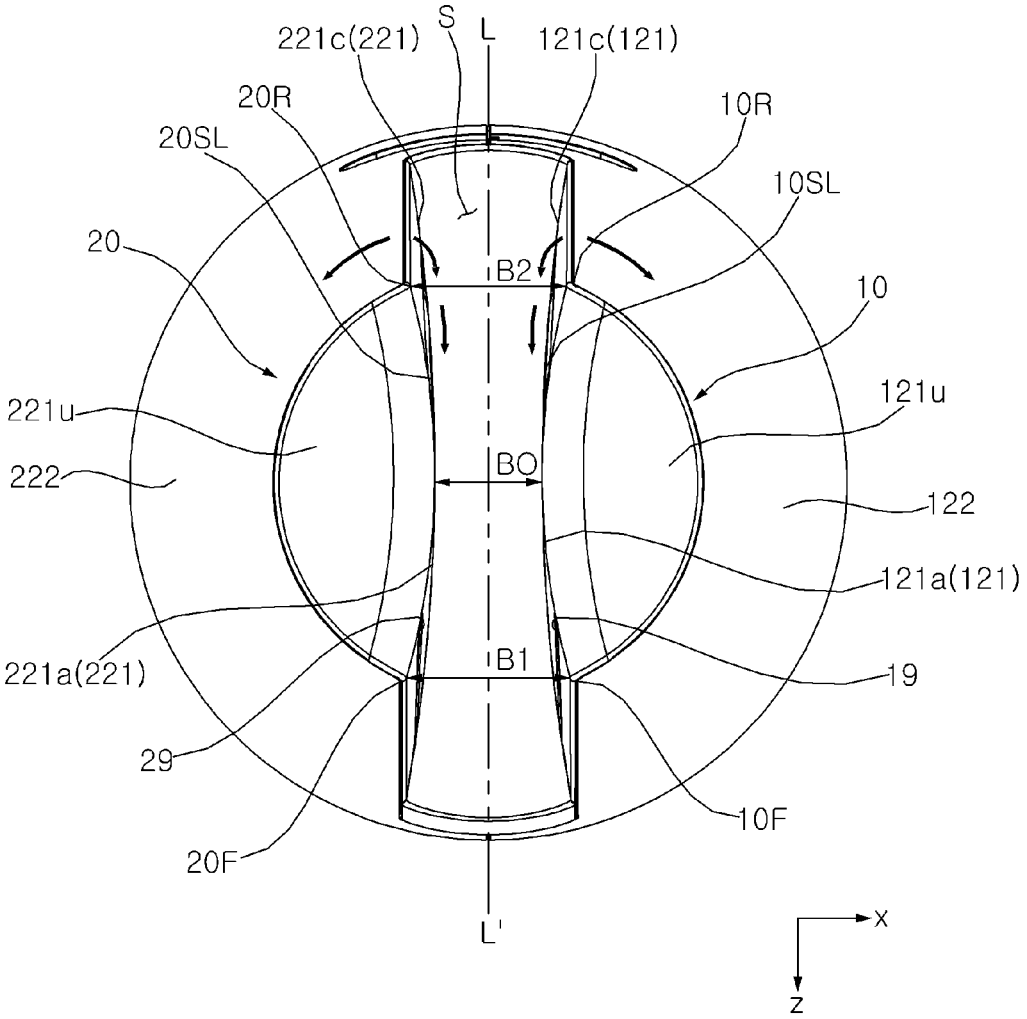
FIGS. 20 and 21 are views for explaining a diffused airflow formed in a first state of a blower according to an embodiment of the present disclosure.

Referring to FIG. 20, the first inner panel 121 and the second inner panel 221 face each other, and may form left and right boundaries of the space S. In this case, the first inner panel 121 may be convex to the right, and the second inner panel 221 may be convex to the left. In other words, a gap between the first inner panel 121 and the second inner panel 221 may decrease from the rear to the front and then increase again. Meanwhile, the gap may be a width of the space S.

A first gap B1 may be defined as a gap between the first front end 10F of the first upper body 10 and the second front end 20F of the second upper body 20. A second gap B2 may be defined as a gap between the first rear end 10R of the first upper body 10 and the second rear end 20R of the second upper body 20. The second gap B2 may be the same as or different from the first gap B1. The reference gap B0 may be a minimum of the gaps between the first inner panel 121 and the second inner panel 221.

For example, in the front-rear direction, a gap between a center of the first inner panel 121 and a center of the second inner panel 221 may be the reference gap B0. For another example, in the front-rear direction, a gap between a part positioned forward than the center of the first inner panel 121 and a part positioned forward than the center of the second inner panel 221 may be the reference gap B0. For another example, in the front-rear direction, a gap between a part positioned rearward than the center of the first inner panel 121 and a part positioned rearward than the center of the second inner panel 221 may be the reference gap B0.

In this case, a width of a rear part of the space S may be the second gap B2, a width of a center part of the space S may be the reference gap B0, and a width of the space S may decrease from the rear part to the center part. In addition, the width of the front part of the space S may be the first gap B1, and the width of the space S may increase from the center part toward a front part.

Referring back to FIGS. 7 and 11, dampers 19 and 29 may be installed to be movable on the upper bodies 10 and 20. Meanwhile, the dampers 19 and 29 may be referred to as boards.

A first damper 19 may be installed in a first space 19S and may protrude into the space S through a first slot 10H (refer to FIG. 12) or may be inserted into the first space 19S.

The first space 19S may be positioned in front of the first wall 11 and may be formed between the first inner panel 121 and the first outer panel 122. The first slot 10H may be adjacent to the first front end 10F of the first upper body 10 and may be formed to penetrate through the first inner panel 121. The first slot 10H may be formed long along the first front end 10F. The first slot 10H may be closed by the first damper 19.

For example, the first damper 19 may be extended while drawing an arc with respect to a center positioned at the rear of the first damper 19. In this case, the first damper may 19 extend a the longitudinal direction of the first slot 10H, and a width of the first damper 19 may be the same as a gap of the first slot 10H.

Meanwhile, a first moving assembly (not shown) may be installed in the first space 19S to move the first damper 19 in a circumferential direction of the first damper 19. For example, the first moving assembly may have a rack-pinion coupling structure or a link coupling structure capable of transmitting a rotational force of an electric motor to the first damper 19. For another example, the first moving assembly may have a connecting structure capable of transmitting a driving force of an actuator to the first damper 19.

A second damper 29 may be installed in a second space 29S and may protrude into the space S through a second slot 20H or may be inserted into the second space 29S.

The second space 29S may be positioned in front of the second wall 21 and may be formed between the second inner panel 221 and the second outer panel 222. The second slot 20H may be adjacent to the second front end 20F of the second upper body 20 and may be formed to penetrate through the second inner panel 221. The second slot 20H may be elongated along the second front end 20F. The second slot 20H may be closed by the second damper 29.

For example, the second damper 29 may extend while drawing an arc with respect to a center positioned at the rear of the second damper 29. In this case, the second damper 29 may extend in a longitudinal direction of the second slot 20H, and a width of the second damper 29 may be the same as a gap of the second slot 20H.

Meanwhile, a second moving assembly (not shown) may be installed in the second space 29S to move the second damper 29 in a circumferential direction of the second damper 29. For example, the second moving assembly may have a rack-pinion coupling structure, a pulley-belt coupling structure, or a link coupling structure capable of transmitting the rotational force of the electric motor to the second damper 29. For another example, the second moving assembly may have a connecting structure capable of transmitting the driving force of the actuator to the second damper 29.

Meanwhile, the second slot 20H may face the first slot 10H. That is, a distance D between the second front end 20F and the second slot 20H may be the same as a distance D between the first front end 10F and the first slot 10H.

Figure 21:
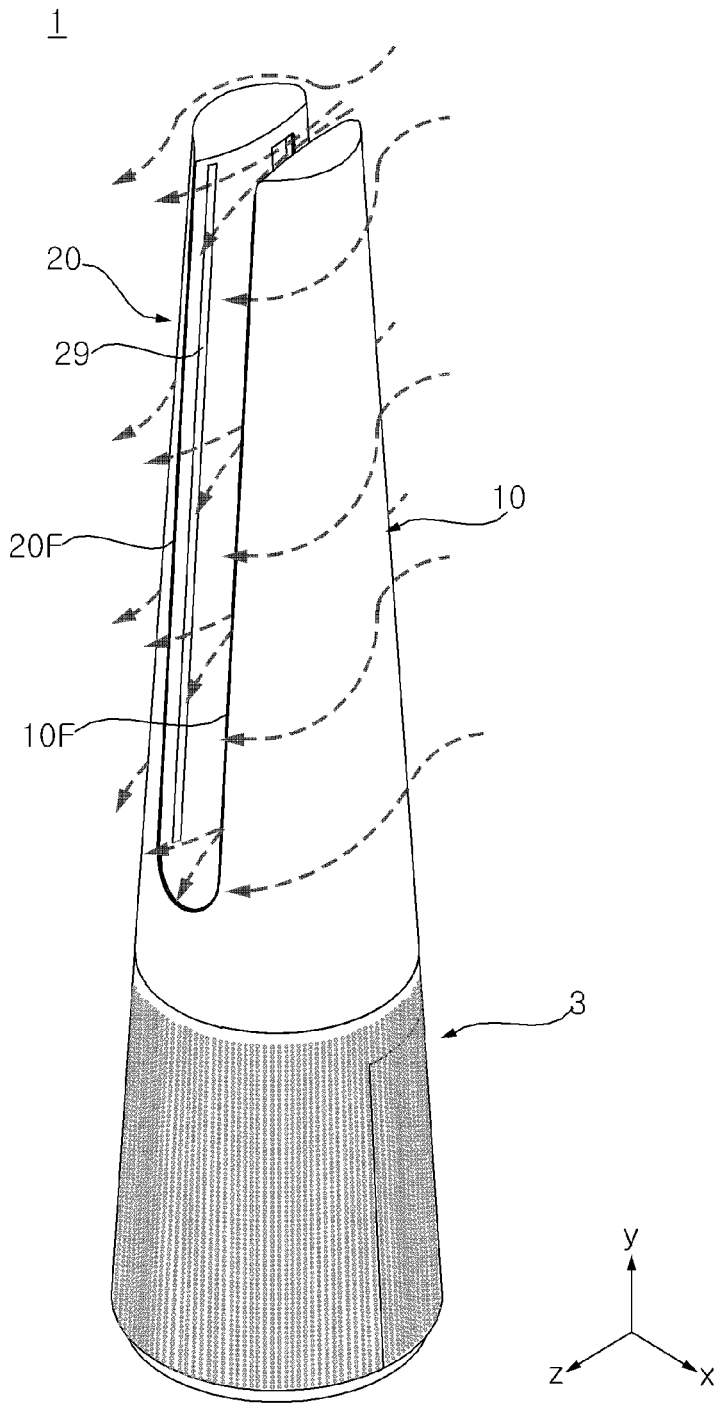

Referring to FIGS. 20 and 21, in a first state of the blower 1, an end of the first damper 19 may be inserted or concealed in the first slot 10H, and an end of the second damper 29 may be inserted or concealed in the second slot 20H. In this case, the end of the first damper 19 may form a surface continuous with the surface of the first inner panel 121, and the end of the second damper 29 may form a surface continuous with the surface of the second inner panel 221.

Air may be discharged from the first slit 10SL and the second slit 20SL to the space S in response to the operation of the fan 6 (refer to FIG. 2). In addition, the air discharged to the space S may flow forward along a surface of the first guide part 121*a* of the first inner panel 121 and a surface of the second guide part 221*a* of the second inner panel 221.

In this case, the air flowing forward may be dispersed left and right along a curvature of the first guide part 121*a* and the second guide part 221*a*. In addition, such a flow of air may form an airflow through which air around the upper bodies 10 and 20 is entrained into the space S, and may form an airflow that flows forward along the surface of the first outer panel 122 and the surface of the second outer panel 222. In this case, the first inlet part 121*c* of the first inner panel 121 and the second inlet portion 221*c* of the second inner panel 221 may guide the flow of air introduced into the space S.

Accordingly, the blower 1 may provide an airflow with a rich air volume to a user or the like.

Figure 22:
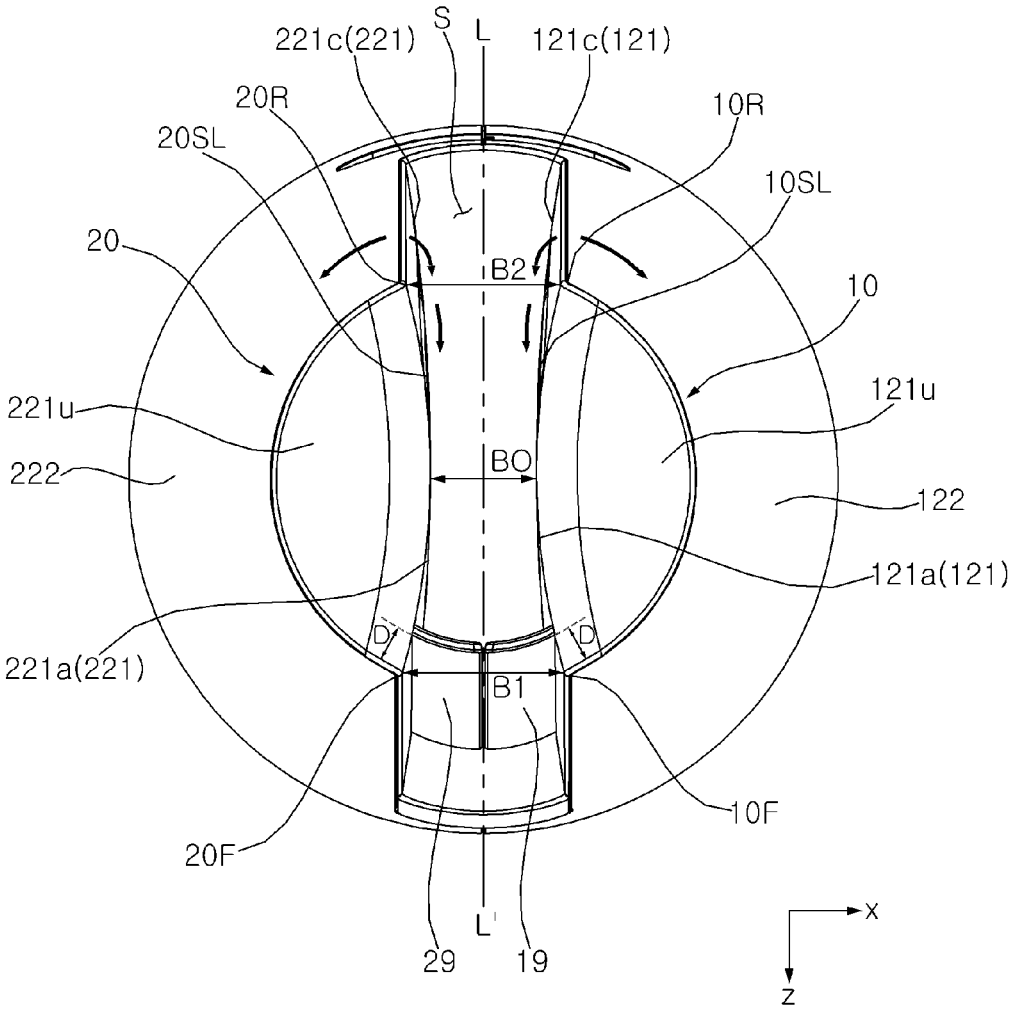
FIGS. 22 and 23 are views for explaining a rising airflow formed in a second state of a blower according to an embodiment of the present disclosure.
Figure 23:
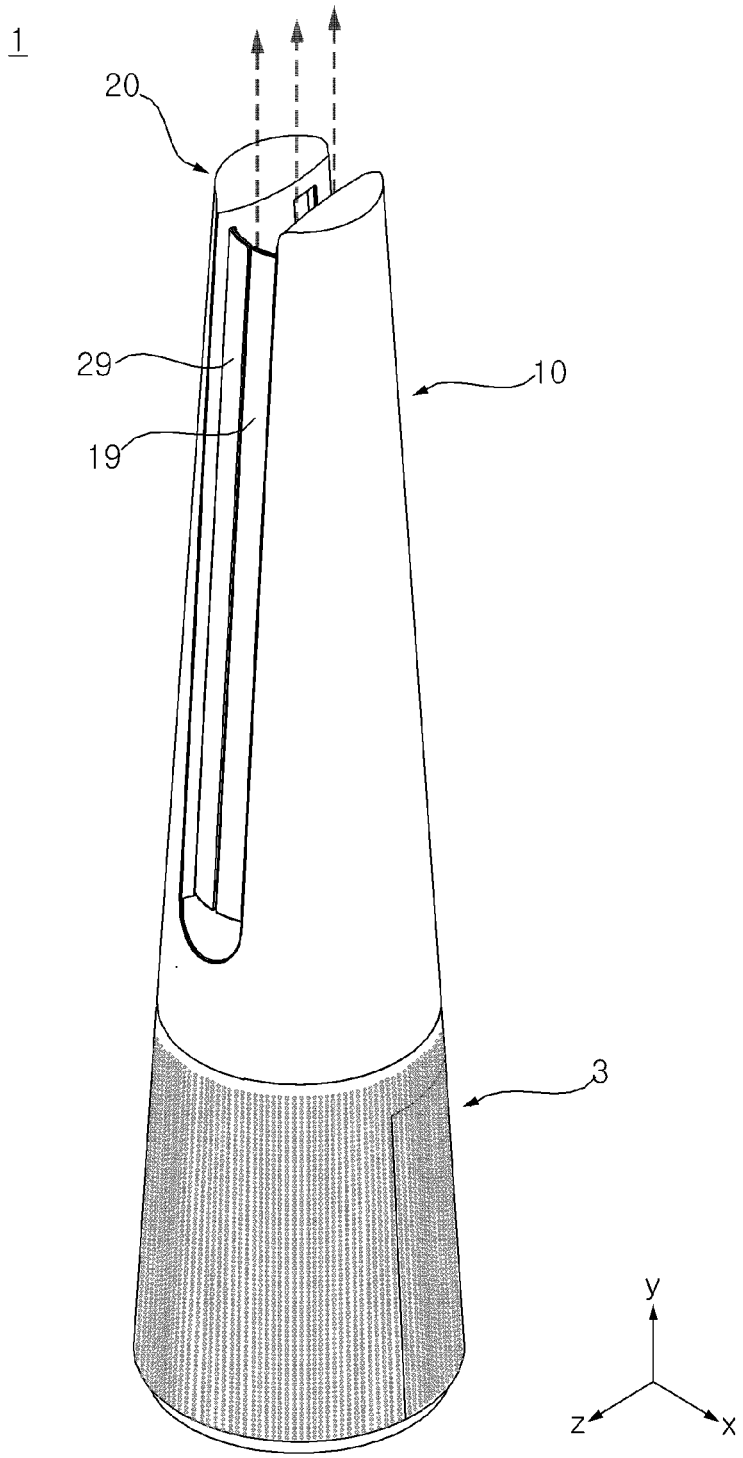

Referring to FIGS. 22 and 23, in a second state of the blower 1, a part of the first damper 19 may pass through the first slot 10H and may be positioned in the space S, and a part of the second damper 29 may pass through the second slot 20H and may be positioned in the space S. In this case, the end of the first damper 19 and the end of the second damper 29 may abut each other, and the first damper 19 and the second damper 29 may close a front of the space S.

Air may be discharged from the first slit 10SL and the second slit 20SL to the space S in response to the operation of the fan 6 (refer to FIG. 2). In addition, the air discharged to the space S may flow forward along the surface of the first guide part 121*a* of the first inner panel 121 and the surface of the second guide part 221*a* of the second inner panel 221, and may be blocked by the first damper 19 and the second damper 29 and rise upward.

Accordingly, the blower 1 may provide an upward airflow to circulate air in an indoor space in which the blower 1 is installed.

Meanwhile, by adjusting the length of the first damper 19 and the second damper 29 protruding into the space S or the positions of the first damper 19 and the second damper 29 with respect to a reference line L-L' extending in the front-rear direction, the wind direction of the air discharged from the blower 1 may be adjusted.

The blower according to the present disclosure has the following effects.

According to at least one of the embodiments of the present disclosure, a blower may be provided that is provided to a user or the like by using the coanda effect on air discharged from a slit or capable of forming an airflow circulating in an indoor space.

According to at least one of the embodiments of the present disclosure, as a first inner panel forming a left boundary of the space is convex to the right, and a second inner panel forming a right boundary of the space is convex to the left, the blower capable of forming an airflow provided in a wide range may be provided.

According to at least one of the embodiments of the present disclosure, a blower capable of smoothly guiding air rising from the inside of the upper body by a vane, a heater, or a protrusion installed inside the upper body to a slit that is an air discharge hole of the blower may be provided.

According to at least one of the embodiments of the present disclosure, a blower capable of smoothly guiding the flow of air discharged from a slit by a connecting member to a panel guiding the air flow of the blower may be provided.

According to at least one of the embodiments of the present disclosure, through the design of the wall, an air flow path inside the blower may be formed to minimize the flow resistance of air, and through the design of the panel, an optimal airflow toward the outside of the blower may be formed.

According to at least one of the embodiments of the present disclosure, as a wall, a panel, and a connecting member are detachably coupled to each other, a blower capable of easily assembling and manufacturing an upper body having various and complex curves may be provided.

According to at least one of the embodiments of the present disclosure, a blower capable of easily disassembling and cleaning or maintaining a panel and/or a connecting member in which foreign matter such as dust is likely to accumulate may be provided.

Further scope of applicability of the present disclosure will become apparent from the detailed description above. However, various changes and modifications within the spirit and scope of the present disclosure may be clearly understood by those skilled in the art, and thus specific embodiments such as the detailed description and preferred embodiments of the present disclosure should be understood as being given by way of example only.

Certain embodiments or other embodiments of the disclosure described above are not mutually exclusive or distinct from each other. Any or all elements of the embodiments of the disclosure described above may be combined or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A blower comprising:

a case to provide an inner space, and the case having an inlet;

a first body provided above the case;

a second body provided above the case and spaced apart from the first body in a left-right direction to provide a blowing space between the first body and the second body; and a fan configured to suction air through the inlet and to discharge air into the first body; wherein the first body includes a first wall configured to provide a first flow path for communicating with the inner space of the case, and a first panel configured to accommodate the first wall within the first panel, and wherein the first panel includes a first slit configured to discharge air from the first flow path to the blowing space and adjacent to a rear end of the first panel, wherein the first wall is opened correspond to the first slit as to include a first end disposed at a front of the first slit and a second end spaced apart rearward from the first end, wherein the blower comprising a first connecting member extending from the first end of the first wall to a portion of the first panel adjacent to the first slit, and being round shaped to turn an airflow of the first flow path in a frontward direction, and wherein the first connecting member has a shape that protrudes toward a rear-inward direction with respect to the first slit.

2. The blower of claim 1, wherein in the second body including a second wall configured to provide a second flow path for communicating with the inner space of the case, and a second panel to accommodate the second wall within the second panel, and wherein the second panel includes a second slit configured to discharge air from the second flow path to an outside of the second panel.

3. The blower of claim 2, wherein the first panel comprises:

a first inner panel provided on one side of the first wall to face the blowing space and to provide the first slit; and a first outer panel provided on an opposite side of the first wall, the first outer panel to contact the first inner panel and provide a first front end and a first rear end of the first body, wherein the second panel comprises:

a second inner panel provided on one side of the second wall to face the blowing space and to provide the second slit; and a second outer panel provided on an opposite side of the second wall, the second outer panel to contact the second inner panel and provide a second front end and a second rear end of the second body, and wherein the blowing space is provided between the first inner panel and the second inner panel.

4. The blower of claim 3, wherein the first body is spaced from the second body in a first direction, wherein the first inner panel is to have a convex shape in a second direction which is opposite to the first direction, wherein the first outer panel is to have a convex shape in the first direction, wherein the second inner panel is to have a convex shape in the first direction, wherein the second outer panel is to have a convex shape in the second direction, wherein a curvature of the first inner panel is less than a curvature of the first outer panel, wherein a curvature of the second inner panel is less than a curvature of the second outer panel, and wherein a gap of the blowing space between the first inner panel and the second inner panel is to decrease from a rear of the blowing space to a center of the blowing space, and the gap of the blowing space is to increase from the center of the blowing space to a front of the blowing space.

5. The blower of claim 1, wherein the first body includes a first opening having an inlet communicating with the first flow path and having an outlet corresponding to the first slit, and having a round shape as to drive the airflow of the first flow path in the frontward direction, and then arrive the first slit, wherein the first opening is provided between the first connecting member and a portion of the first wall near the second end.

6. The blower of claim 5, wherein the first panel includes:

a first bending portion that is bent toward the first flow path;

a first guide portion to connect to the first bending portion in a front of the first bending portion; and, a first inlet portion that is spaced apart, in a rearward direction, from the first bending portion, wherein the first slit is provided between the first bending portion and the first inlet portion.

7. The blower of claim 6, wherein the first end of the wall is adjacent to the first guide portion, and the second end is connected to the first inlet portion, wherein at least a portion of the first bending portion is provided between the first end of the first wall and the second end of the first wall, wherein the first connecting member is connected to the first bending portion, and wherein the first opening is provided between the first connecting member and the first bending portion, and the first wall and the first inlet portion.

8. The blower of claim 7, wherein a first end of the first connecting member is provided between the first wall and the first guide portion, wherein a second end of the first connecting member is connected to an end of the first bending portion, wherein the first connecting member includes:

a first portion configured to provide the first end of the first connecting member;

a second portion bent from the first portion toward the first opening; and a third portion to extend from the second portion toward the first bending portion and to provide the second end of the first connecting member.

9. The blower of claim 8, wherein the second end of the first wall is connected to an inside of the first inlet portion, wherein the first inlet portion includes a front portion to protrude from the second end of the first wall toward the first bending portion and having an inner surface facing the third portion, and wherein the first opening is provided between the second portion, the third portion and the first bending portion, and the first wall and the front portion.

10. The blower of claim 9, wherein a gap between the second portion and the first wall is constant or becomes smaller toward a downstream of the first opening.

11. The blower of claim 9, wherein a gap between the third portion and the front portion is constant or becomes smaller toward a downstream of the first opening.

12. The blower of claim 9, wherein the first body includes a groove provided in at least one of the third portion and the first bending portion and facing an inner surface of the front portion.

13. The blower of claim 9, wherein the first body includes a spacer to couple to the first bending portion and to the first inlet portion, and the spacer is provided between the first bending portion and the front portion, and wherein a thickness of the front portion is increased as it is adjacent to the spacer.

14. The blower of claim 7, wherein the first connecting member includes a first hook to hook couple to a first locking part at the first wall.

15. The blower of claim 14, wherein the first bending portion includes a second hook to hook couple to a second locking part at the first connecting member.

16. The blower of claim 1, wherein the first flow path is elongated in an up-down direction, wherein the first body includes a first vane provided in the first flow path adjacent to the first slit, and the first vane is to have a convex upward shape, and wherein a rear of the first vane is above a front of the first vane.

17. The blower of claim 1, wherein the first wall is provided as a round shape locating the first slit radially inward as extends from the first end to the second end.

* * * * *